US005545350A

United States Patent [19]

Baker et al.

[11] Patent Number: 5,545,350

[45] **Date of Patent: *Aug. 13, 1996**

[54] CONCENTRATED FABRIC SOFTENER COMPOSITIONS CONTAINING BIODEGRADABLE FABRIC SOFTENERS

[75] Inventors: Ellen S. Baker, Cincinnati, Ohio; Jean-Francois Bodet, Newcastle Upon Tyne, Great Britain; Hugo J. M. Demeyere, Merchtem, Belgium; Frederick A. Hartman, Cincinnati, Ohio; Bruno A. Hubesch, Tervuren-Vossem, Belgium; Robert Mermelstein, Cincinnati, Ohio; Lucille F. Taylor, Middletown, Ohio; Errol H. Wahl, Cincinnati, Ohio

[73] Assignee: The Procter & Gamble Company, Cincinnati, Ohio

[ * ] Notice: The term of this patent shall not extend beyond the expiration date of Pat. No. 5,368,756.

[21] Appl. No.: 333,902

[22] Filed: Nov. 3, 1994

Related U.S. Application Data

[63] Continuation of Ser. No. 101,130, Aug. 2, 1993, abandoned, which is a continuation of Ser. No. 881,979, May 12, 1992, abandoned.

[51] Int. Cl.[6] ..... D06M 13/46

[52] U.S. Cl. ..... 510/517; 510/521; 510/515; 510/522; 510/524; 510/525; 510/527

[58] Field of Search ..... 252/8.6, 8.7, 8.8, 252/8.9, 174.21, 547, 8.75

[56] References Cited

U.S. PATENT DOCUMENTS

| | | | |
|---|---|---|---|
| 3,904,533 | 9/1975 | Neiditch et al. | 252/8.8 |
| 3,915,867 | 10/1975 | Kang et al. | 252/8.8 |
| 4,137,180 | 1/1979 | Naik et al. | 252/8.8 |
| 4,401,578 | 8/1983 | Verbruggen | 252/8.8 |
| 4,456,554 | 6/1984 | Walz et al. | 260/403 |
| 4,756,850 | 7/1988 | Navar | 252/547 |
| 4,767,547 | 8/1988 | Straathof | 252/8.8 |
| 4,808,321 | 2/1988 | Walley | 252/8.8 |
| 4,844,823 | 7/1989 | Jacques et al. | 252/8.8 |
| 4,874,554 | 10/1989 | Lange et al. | 260/404 |
| 4,915,854 | 4/1990 | Mao et al. | 252/8.8 |
| 4,923,642 | 5/1990 | Rutzen et al. | 260/404 |
| 5,019,280 | 5/1991 | Caswell et al. | 252/8.8 |
| 5,066,414 | 11/1991 | Chang | 252/8.8 |
| 5,185,088 | 2/1993 | Hartman et al. | 252/8.6 |
| 5,368,756 | 11/1994 | Vogel et al. | 252/8.8 |

FOREIGN PATENT DOCUMENTS

| | | |
|---|---|---|
| 9002886A | 8/1991 | Brazil . |
| 122141A2 | 10/1984 | European Pat. Off. . |
| 240727A2 | 10/1987 | European Pat. Off. . |
| 0239910A2 | 10/1987 | European Pat. Off. . |
| 243735A2 | 11/1987 | European Pat. Off. . |
| 284036A2 | 9/1988 | European Pat. Off. . |
| 0299176A3 | 1/1989 | European Pat. Off. . |
| 336267A2 | 10/1989 | European Pat. Off. . |
| 0409504A2 | 1/1991 | European Pat. Off. . |
| 409502A2 | 1/1991 | European Pat. Off. . |
| 0420465A2 | 4/1991 | European Pat. Off. . |
| 91/201887 | 7/1991 | European Pat. Off. . |
| 462806A2 | 12/1991 | European Pat. Off. . |
| 0507478A1 | 10/1992 | European Pat. Off. . |
| 63-223099 | 9/1988 | Japan . |
| 1-229877 | 9/1989 | Japan . |
| 1-249129 | 10/1989 | Japan . |
| 2-139480 | 5/1990 | Japan . |
| WO89/11522 | 11/1989 | WIPO . |
| WO89/11527 | 11/1989 | WIPO . |
| WO91/01295 | 2/1991 | WIPO . |
| WO91/12364 | 8/1991 | WIPO . |
| WO92/17523 | 10/1992 | WIPO . |
| WO92/18593 | 10/1992 | WIPO . |

OTHER PUBLICATIONS

A. M. Schwartz et al., "Surface Active Agents—Their Chemistry and Technology," 1949, Interscience Publishers, Inc., N.Y., pp. 180–185. *No Month.

R. Puchta, "Catonic Surfactants in Laundry Detergents and Laundry Aftertreatment Aids," Feb. 1984, JAOCS, vol. 61, No. 2, pp. 367–376.

R. R. Egan, "Cationic Surfact Active Agents as Fabric Softeners," Jan. 1978, vol. 55, J. Am. Oil Chemists' Soc., pp. 118–121.

M. J. Schick, "Micelle Formation in Mixtures of . . . and Cationic Detergents," vol. 43, J. Am. Oil Chemists' Society, pp. 681–682. **No Date.

*Primary Examiner*—Anthony Green

*Attorney, Agent, or Firm*—Robert B. Aylor; Betty J. Zea

[57] ABSTRACT

Compositions are disclosed containing fabric softener compound having two hydrophobic groups attached to the remainder of the compound through ester linkages (DEQA), said compositions being concentrated and containing viscosity/dispersibility modifiers which are single long chain cationic surfactants, highly ethoxylated nonionic surfactants and/or mixtures thereof. Premixes of the DEQA and viscosity modifiers to lower the viscosity of the molten DEQA are disclosed. Processes for making aqueous liquid compositions from solid particulate compositions containing the DEQA are also disclosed.

56 Claims, No Drawings

CONCENTRATED FABRIC SOFTENER COMPOSITIONS CONTAINING BIODEGRADABLE FABRIC SOFTENERS

CROSS-REFERENCE TO RELATED APPLICATION

This is a continuation of application Ser. No. 08/101,130, filed on Aug. 2, 1993 now abandoned; which is a continuation of application Ser. No. 07/881,979, filed on May 12, 1992, now abandoned.

TECHNICAL FIELD

The present invention relates to concentrated liquid and solid textile treatment compositions. In particular, it relates to textile treatment compositions for use in the rinse cycle of a textile laundering operation to provide fabric softening/static control benefits, the compositions being characterized by excellent storage stability and viscosity characteristics, as well as biodegradability.

BACKGROUND OF THE INVENTION

The prior art discloses many problems associated with formulating and preparing fabric conditioning formulations. See, for example, U.S. Pat. No. 3,904,533, Neiditch et al. issued Sep. 9, 1975. Japanese Laid Open Publication 1,249,129, filed Oct. 4, 1989, discloses a problem with dispersing fabric softener actives containing two long hydrophobic chains interrupted by ester linkages ("diester quaternary ammonium compounds") and solves it by rapid mixing. U.S. Pat. No. 5,066,414, Chang, issued Nov. 19, 1991, teaches and claims compositions containing mixtures of quaternary ammonium salts containing at least one ester linkage, nonionic surfactant such as a linear alkoxylated alcohol, and liquid carrier for improved stability and dispersibility. U.S. Pat. No. 4,767,547, Straathof et al., issued Aug. 30, 1988, claims compositions containing either diester, or monoester quaternary ammonium compounds where the nitrogen has either one, two, or three methyl groups, stabilized by maintaining a critical low pH of from 2.5 to 4.2.

U.S. Pat. No. 4,401,578, Verbruggen, issued Aug. 30, 1983 discloses hydrocarbons, fatty acids, fatty acid esters, and fatty alcohols as viscosity control agents for fabric softeners (the fabric softeners are disclosed as optionally comprising ester linkages in the hydrophobic chains). WO 89/115 22-A (DE 3,818,061-A; EP-346,634-A), with a priority of May 27, 1988, discloses diester quaternary ammonium fabric softener components plus a fatty acid. European Pat. No. 243,735 discloses sorbitan esters plus diester quaternary ammonium compounds to improve dispersions of concentrated softener compositions.

The art also teaches compounds that alter the structure of diester quaternary ammonium compounds by substituting, e.g., a hydroxy ethyl for a methyl group or a polyalkoxy group for the alkoxy group in the two hydrophobic chains. Specifically, U.S. Pat. No. 3,915,867, Kang et al., issued Oct. 28, 1975, discloses the substitution of a hydroxyethyl group for a methyl group. A softener material with specific cis/trans content in the long hydrophobic groups is disclosed in Jap. Pat. Appln. 63-194316, filed Nov. 21, 1988. Compounds with alkoxy, acyloxy, and alkyl groups are disclosed in, e.g., U.S. Pat. No. 4,923,642, Rutzen et al., issued May 8, 1990.

U.S. Pat. No. 4,844,823, Jaques et al., issued Jul. 4, 1989, teaches fabric softener compositions containing, as one option, 3% to 20% diester quaternary ammonium compound, as in U.S. Pat. No. 3,915,867, supra, and fatty alcohol to improve softening performance.

Diester quaternary ammonium compounds with a fatty acid, alkyl sulfate, or alkyl sulfonate anion are disclosed in European Pat. No. 336,267-A with a priority of Apr. 2, 1988. European Pat. No. 418,273, with a priority date of May 22, 1988, discloses, e.g., diester quaternary ammonium compounds and DTDMAC (ditallow dimethyl ammonium chloride) for improved release from a substrate in an automatic clothes dryer.

U.S. Pat. No. 4,923,642, Rutzen et al., issued May 8, 1990, discloses ester fabric softener materials, but with a different fatty acid, i.e., one that is etherified. (The fatty acid is substituted with hydroxy, alkoxy, etc. groups.)

Ger. Offen. 1,935,499, Distler et al., published Jan. 14, 1971, discloses the reaction of fatty acid methyl esters with alkyl diethanolamine and quaternized by methyl sulfate to create a diester quaternary ammonium fabric softener.

U.S. Pat. No. 4,456,554, Walz et al., issued Jun. 26, 1984, discloses alkyl diacyloxyalkyl amines quaternized by trialkyl phosphonates or phosphites.

Ger. Offen. DE 638,918, Henkel, published May 18, 1988 as EP 267,551-A, discloses diester quaternary ammonium compounds in which the fatty acid is substituted by a hydroxy fatty acid.

E.P. Pat. Appln. 284,036-A, Hofinger et al., published Mar. 23, 1988, discloses preparation of diester quaternary ammonium compounds by reacting alkanolamine with a glyceride. (The German equivalent is DE 3710064).

U.S. Pat. No. 4,808,321, Walley, issued Feb. 28, 1989, teaches fabric softener compositions comprising monoester analogs of ditallow dimethyl ammonium chloride which are dispersed in a liquid carrier as sub-micron particles through high shear mixing, or particles can optionally be stabilized with emulsifiers such as nonionic C14–18 ethoxylates.

Ger. Offen. 8,911,522, Volkel et al., published May 27, 1988, describes aqueous fabric softener compositions with a diester quaternary ammonium compound having two $C_{10}$ to $C_{22}$ acyloxyalkyl chains and a fatty acid.

Ger. Offen. 9,101,295, Trius et al., published Jul. 17, 1989, describes a process to prepare diester quaternary ammonium compounds by reacting alkanolamine and fatty acid. Thereafter, the amine is alkylated to form the quaternary compound.

E.P. Appln. 336,267, Rutzen et al., with a priority date of Apr. 2, 1988, and published Oct. 11, 1989, discloses diester quaternary ammonium compounds having at least one hydroxyalkyl group.

E.P. Appln. No. 91201887.6, Demeyere et al., filed Jul. 8, 1991, teaches perfume/active mixes adsorbed on finely divided silica.

E.P. Appln. 243,735, Nusslein et al., published Nov. 4, 1987, discloses sorbitan ester plus diester quaternary ammonium compounds to improve dispersibility of concentrated dispersions.

E.P. Appln. 409,502, Tandela et al., published Jan. 23, 1991, discloses, e.g., ester quaternary ammonium compounds, and a fatty acid material or its salt.

E.P. Appln. 240,727, Nusslein et al., priority date of Mar. 12, 1986, teaches diester quaternary ammonium compounds with soaps or fatty acids for improved dispersibility in water.

U.S. Pat. No. 4,874,554, Lange et al., issued Oct. 17, 1989, discloses diester quaternary ammonium compounds having polyethoxy groups and the process of making these compounds for use in hair cosmetic preparations.

All of the above patents and patent applications are incorporated herein by reference.

SUMMARY OF THE INVENTION

The concentrated fabric softener compositions herein are selected from the group consisting of:

I. a solid particulate composition comprising:

(A) from about 50% to about 95% of biodegradable diester quaternary ammonium fabric softening compound; and (B) from about 3% to about 30% of viscosity and/or dispersibility modifier selected from the group consisting of:

1. single-long-chain-alkyl, cationic surfactant;
2. nonionic surfactant with at least 8 ethoxy moieties; or
3. mixtures thereof; and II. a concentrated liquid composition comprising:

(A) from about 15% to about 50% of biodegradable diester quaternary ammonium fabric softening compound; and (B) from about 0.1% to about 30% of viscosity and/or dispersibility modifier selected from the group consisting of:

1. single-long-chain-alkyl, cationic surfactant;
2. nonionic surfactant with at least 8 ethoxy moieties; or
3. mixtures thereof; and (C) liquid carrier;

wherein the level of water in the liquid carrier is more than about 50%, preferably more than about 80% by weight of the carrier and said diester quaternary ammonium fabric softening compound is at least 80% diester.

Single long chain quaternary ammonium compounds, especially ones that also contain an ester linkage, and specific relatively highly ethoxylated nonionic surfactants, or mixtures of these, provide and maintain concentrated compositions at low viscosities and/or with improved dispersibility. Several materials, as discussed hereinafter, including, e.g., substantially linear fatty acid and/or fatty alcohol monoesters in any diester quaternary ammonium compound premix, III, described in detail hereinafter, which is used to prepare said concentrated fabric softener composition, will improve fluidity, either alone, or in combination with (B).

The compositions can be concentrated aqueous liquids, containing from about 15% to about 50%, preferably from about 15% to about 35%, more preferably from about 15% to about 30%, of said biodegradable diester softening compound, or can be concentrated to particulate solids, containing from about 50% to about 95%, preferably from about 60% to about 90%, of said softening compound, which is highly preferred.

In another aspect of the invention, water can be added to the particulate solid compositions to form dilute or concentrated liquid softener compositions with a concentration of said diester softening compound of from about 5% to about 50%, preferably from about 5% to about 35%, more preferably from about 5% to about 30%. The particulate solid composition (1) can also be used directly in the rinse bath to provide adequate usage concentration (e.g., from about 10 to about 1,000 ppm, preferably from about 50 to about 500 ppm, of total active ingredient). The liquid compositions can be added to the rinse to provide the same usage concentrations. The benefits of adding water to the particulate solid composition to form aqueous compositions to be added to the rinse bath include the ability to transport less weight making shipping more economical, and the ability to form liquid compositions similar to those that are normally sold to consumers with lower energy input (i.e., less shear and/or lower temperature) and (2) simplifying measuring and dispersing the softener compounds.

Yet another aspect of the invention involves the low viscosity premixes prepared during preparation of the concentrated fabric softener compositions.

DETAILED DESCRIPTION OF THE INVENTION

(A). Diester Quaternary Ammonium Compound (DEQA)

The present invention contains DEQA as an essential component:

I. for solid compositions: from about 50% to about 95%, preferably from about 60% to about 90%, and II. for liquid compositions: from about 15% to about 50%, preferably from about 17% to about 35%, more preferably from about 18% to about 30%, of said diester quaternary ammonium fabric softening compound (DEQA), preferably DEQA having the formula:

$$(R)_{4-m}—N^{\oplus}—(CH_2)_n—Y—R^2]_m X^{\ominus} \quad \text{(Formula I)}$$

wherein each Y=—O—(O)C—, or —C(O)—O—;

m=2 or 3;

each n=1 to 4;

each R substituent is a short chain $C_1$–$C_6$, preferably $C_1$–$C_3$ alkyl or hydroxyalkyl group, e.g., methyl (most preferred), ethyl, propyl, hydroxyethyl, and the like, benzyl or mixtures thereof; each $R^2$ is a long chain $C_{12}$–$C_{22}$ hydrocarbyl, or substituted hydrocarbyl substituent, preferably $C_{15}$–$C_{19}$ alkyl and/or alkylene, most preferably $C_{15}$–$C_{17}$ straight chain alkyl and/or alkylene; and the counterion, $X^-$, can be any softener-compatible anion, for example, chloride, bromide, methylsulfate, formate, sulfate, nitrate and the like.

Carbonate esters, i.e., where Y=—O—C(O)—O, are unstable compounds and are not included as Formula I compounds.

It will be understood that substituents R and $R_2$ can optionally be substituted with various groups such as alkoxyl or hydroxyl groups, and/or can be saturated, unsaturated, straight, and/or branched so long as the $R^2$ groups maintain their basically hydrophobic character. The preferred compounds can be considered to be diester variations of ditallow dimethyl ammonium chloride (DTDMAC), which is a widely used fabric softener. At least 80% of the DEQA is in the diester form, and from 0% to about 20% can be DEQA monoester (e.g., only one —Y—$R^2$ group).

As used herein, when the diester is specified, it will include the monoester that is normally present, but not additional monoester that is added. For softening, the percentage of diester should be as high as possible, preferably more than 90%.

The above compounds used as the primary active softener ingredient in the practice of this invention can be prepared using standard reaction chemistry. In one synthesis of a di-ester variation of DTDMAC, an amine of the formula $RN(CH_2CH_2OH)_2$ is esterified at both hydroxyl groups with an acid chloride of the formula $R^2C(O)Cl$, then quaternized with an alkyl halide, RX, to yield the desired reaction product (wherein R and $R^2$ are as defined hereinbefore). A method for the synthesis of a preferred di-ester softening compound is disclosed in detail hereinafter. However, it will be appreciated by those skilled in the chemical arts that this reaction sequence allows a broad selection of compounds to be prepared. The following are non-limiting examples (wherein all long-chain alkyl substituents are straight-chain):

$[HO{-}CH(CH_3)CH_2][CH_3]^{\oplus}N[CH_2CH_2OC(O)C_{15}H_{31}]_2\ Br^{\ominus}$ $[C_2H_5]_2^{\oplus}N[CH_2CH_2OC(O)C_{17}H_{35}]_2\ Cl^{\ominus}$ $[CH_3][C_2H_5]^{\oplus}N[CH_2CH_2OC(O)C_{13}H_{27}]_2\ I^{\ominus}$ $[C_3H_7][C_2H_5]^{\oplus}N[CH_2CH_2OC(O)C_{15}H_{31}]_2\ SO_4^{\ominus}CH$ $[CH_3]_2^{\oplus}N{-}CH_2CH_2OC(O)C_{15}H_{31}\ Cl^{\ominus}$
$\quad\quad |$
$\quad\quad CH_2CH_2OC(O)C_{17}H_{35}$ $[CH_2CH_2OH][CH_3]^{\oplus}N[CH_2CH_2OC(O)R^2]_2\ Cl^{\ominus}$ $[CH_3]_2^{\oplus}N[CH_2CH_2OC(O)R^2]\ Cl^{\ominus}$ where $-C(O)R^2$ is derived from hardened tallow.

Since the foregoing compounds (diesters) are somewhat labile to hydrolysis, they should be handled rather carefully when used to formulate the compositions herein. For example, stable liquid compositions herein are formulated at a pH in the range of about 2 to about 5, preferably from about 2 to about 4.5, more preferably from about 2 to about 4. The pH can be adjusted by the addition of a Bronsted acid. pH ranges for making stable softener compositions containing diester quaternary ammonium fabric softening compounds are disclosed in U.S. Pat. No. 4,767,547, supra, and is incorporated herein by reference.

Examples of suitable Bronsted acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, methylsulfonic and ethylsulfonic acid. Preferred acids are hydrochloric and phosphoric acids.

The diester quaternary ammonium fabric softening compound (DEQA) can also have the general formula:

$$\begin{array}{l} R^2C(O)OCH_2 \\ \quad\quad\quad\quad\quad\quad \diagdown \\ \quad\quad\quad\quad\quad\quad CHCH_2^{\oplus}NR_3\ X^{\ominus} \\ \quad\quad\quad\quad\quad\quad \diagup \\ RC(O)O \end{array} \qquad \text{(Formula II)}$$

wherein each R, $R^2$, and X have the same meanings as before. Such compounds include those having the formula:

$[CH_3]_3^{\oplus}N[CH_2CH(CH_2OC[O]R^2)OC(O)R^2]\ Cl^{\ominus}$ where $\cdot OC(O)R^2$ is derived from hardened tallow.

Preferably each R is a methyl or ethyl group and preferably each $R^2$ is in the range of $C_{15}$ to $C_{19}$. Degrees of branching, substitution and/or non-saturation can be present in the alkyl chains. The anion $X^-$ in the molecule is preferably the anion of a strong acid and can be, for example, chloride, bromide, iodide, sulphate and methyl sulphate; the anion can carry a double charge in which case $X^-$ represents half a group. These compounds, in general, are more difficult to formulate as stable concentrated liquid compositions.

These types of compounds and general methods of making them are disclosed in U.S. Pat. No. 4,137,180, Naik et al., issued Jan. 30, 1979, which is incorporated herein by reference.

Synthesis of a Diester Quaternary Ammonium Compound

Synthesis of a preferred biodegradable, diester quaternary ammonium softening compound used herein can be accomplished by the following two-step process: Step A. Synthesis of Amine $$(CH_3){-}N{-}(CH_2CH_2OH)_2 + 2\ ClC(O)C_{15}H_{31} \xrightarrow{(C_2H_5)_3N} CH_3{-}N{-}[CH_2CH_2OC(O)C_{15}H_{31}]_2$$

0.6 mole of diethanol methyl amine is placed in a 3-liter, 3-necked flask equipped with a reflux condenser, argon (or nitrogen) inlet and two addition funnels. In one addition funnel is placed 0.4 moles of triethylamine and in the second addition funnel is placed 1.2 moles of palmitoyl chloride in a 1:1 solution with methylene chloride. Methylene chloride (750 mL) is added to the reaction flask containing the amine and heated to 35° C. (water bath). The triethylamine is added dropwise, and the temperature is raised to 40°–45° C. while stirring over one-half hour. The palmitoyl chloride/methylene chloride solution is added dropwise and allowed to heat at 40°–45° C. under inert atmosphere overnight (12–16 h).

The reaction mixture is cooled to room temperature and diluted with chloroform (1500 mL). The chloroform solution of product is placed in a separatory funnel (4 L) and washed with saturated NaCl, diluted $Ca(OH)_2$, 50% $K_2CO_3$ (3 times)*, and, finally, saturated NaCl. The organic layer is collected and dried over $MgSO_4$, filtered and solvents are removed via rotary evaporation. Final drying is done under high vacuum (0.25 mm Hg).

*Note: 50% $K_2CO_3$ layer will be below chloroform layer. Step B. Quaternization $$CH_3{-}N{-}[CH_2CH_2OC(O)C_{15}H_{31}]_2 \xrightarrow{CH_3Cl} (CH_3)_2{-}N^{\oplus}{-}[CH_2CH_2OC(O)C_{15}H_{31}]_2\ Cl^{\ominus}$$

0.5 moles of the methyl diethanol palmitate amine from Step A is placed in an autoclave sleeve along with 200–300 mL of acetonitrile (anhydrous). The sample is then inserted into the autoclave and purged three times with $N_2$ (16275 mm Hg/21.4 ATM) and once with $CH_3Cl$. The reaction is heated to 80° C. under a pressure of 3604 mm Hg/4.7 ATM $CH_3Cl$ for 24 hours. The autoclave sleeve is then removed from the reaction mixture. The sample is dissolved in chloroform and solvent is removed by rotary evaporation, followed by drying on high vacuum (0.25 mm Hg).

(B). Viscosity/Dispersibility Modifiers (B)(1)The Single-Long-Chain Alkyl Cationic Surfactant The mono-long-chain-alkyl (water-soluble) cationic surfactants: I. in solid compositions are at a level of from 0% to about 15%, preferably from about 3% to about 15%, more preferably from about 5% to about 15%, and II. in liquid compositions are at a level of from 0% to about 15%, preferably from about 0.5% to about 10%, the total single-long-chain cationic surfactant present being at least at an effective level.

Such mono-long-chain-alkyl cationic surfactants useful in the present invention are, preferably, quaternary ammonium salts of the general formula:

$$[R^2N^{\oplus}R_3]X^{\ominus}$$

wherein the $R^2$ group is $C_{10}$–$C_{22}$ hydrocarbon group, preferably $C_{12}$–$C_{18}$ alkyl group or the corresponding ester linkage interrupted group with a short alkylene ($C_1$–$C_4$) group between the ester linkage and the N, and having a similar hydrocarbon group, e.g., a fatty acid ester of choline, preferably $C_{12}$–$C_{14}$ (coco) choline ester and/or $C_{16}$–$C_{18}$ tallow choline ester. Each R is a $C_1$–$C_4$ alkyl or substituted (e.g., hydroxy) alkyl, or hydrogen, preferably methyl, and the counterion $X^{\ominus}$ is a softener compatible anion, for example, chloride, bromide, methyl sulfate, etc.

The ranges above represent the amount of the single-long-chain-alkyl cationic surfactant which is added to the composition of the present invention. The ranges do not include the amount of monoester which may be present in component (A), of Formula I or II, the diester quaternary ammonium compound. Preferably, the compositions of the present invention are essentially free of the monoester of Formula II. Preferably, the monoester of Formula I present in DEQA raw material is less than about 5% by weight, preferably less than about 1%.

The long chain group $R^2$, of the single-long-chain-alkyl cationic surfactant, typically contains an alkylene group having from about 10 to about 22 carbon atoms, preferably from about 12 to about 16 carbon atoms for solid compositions, and preferably from about 12 to about 18 carbon atoms for liquid compositions. This $R^2$ group can be attached to the cationic nitrogen atom through a group containing one, or more, ester, amide, ether, amine, etc., preferably ester, linking groups which can be desirable for increased hydrophilicity, biodegradability, etc. Such linking groups are preferably within about three carbon atoms of the nitrogen atom. Suitable biodegradable single-long-chain alkyl cationic surfactants containing an ester linkage in the long chain are described in U.S. Pat. No. 4,840,738, Hardy and Walley, issued Jun. 20, 1989, said patent being incorporated herein by reference.

If the corresponding, non-quaternary amines are used, any acid (preferably a mineral or polycarboxylic acid) which is added to keep the ester groups stable will also keep the amine protonated in the compositions and preferably during the rinse so that the amine has a cationic group. The composition is buffered (pH from about 2 to about 5, preferably from about 2 to about 4) to maintain an appropriate, effective charge density in the aqueous liquid concentrate product and upon further dilution e.g., to form a less concentrated product and/or upon addition to the rinse cycle of a laundry process.

It will be understood that the main function of the water-soluble cationic surfactant is to lower the viscosity and/or increase the dispersibility of the diester softener and it is not, therefore, essential that the cationic surfactant itself have substantial softening properties, although this may be the case. Also, surfactants having only a single long alkyl chain, presumably because they have greater solubility in water, can protect the diester softener from interacting with anionic surfactants and/or detergent builders that are carried over into the rinse. These viscosity and/or dispersibility modifiers also provide added physical stability to the composition.

Other cationic materials with ring structures such as alkyl imidazoline, imidazolinium, pyridine, and pyridinium salts having a single $C_{12}$–$C_{30}$ alkyl chain can also be used. Very low pH is required to stabilize, e.g., imidazoline ring structures.

Some alkyl imidazolinium salts useful in the present invention have the general formula:

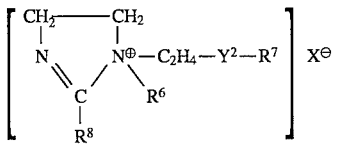

wherein $Y^2$ is —C(O)—O—, —O—(O)—C—, —C(O)—N($R^5$), or —N($R^5$)—C(O)— in which $R^5$ is hydrogen or a $C_1$–$C_4$ alkyl radical; $R^6$ is a $C_1$–$C_4$ alkyl radical; $R^7$ and $R^8$ are each independently selected from R and $R^2$ as defined hereinbefore for the single-long-chain cationic surfactant with only one being $R^2$.

Some alkyl pyridinium salts useful in the present invention have the general formula:

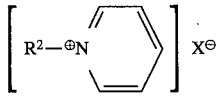

wherein $R^2$ and $X^{\ominus}$ are as defined above. A typical material of this type is cetyl pyridinium chloride.

(B)(2) Nonionic Surfactant (Alkoxylated Materials)

Suitable nonionic surfactants to serve as the viscosity/dispersibility modifier include addition products of ethylene oxide and, optionally, propylene oxide, with fatty alcohols, fatty acids, fatty amines, etc.

Any of the alkoxylated materials of the particular type described hereinafter can be used as the nonionic surfactant. In general terms, the nonionics herein, when used alone, in solid compositions are at a level of from about 5% to about 20%, preferably from about 8% to about 15%, and in liquid compositions are at a level of from 0% to about 5%, preferably from about 0.1% to about 5%, more preferably from about 0.2% to about 3%, and even more preferably from about 1.5% to about 3%. Suitable compounds are substantially water-soluble surfactants of the general formula:

$$R^2—Y—(C_2H_4O)_z—C_2H_4OH$$

wherein $R^2$ for both solid and liquid compositions is selected from the group consisting of primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of from about 8 to about 20, preferably from about 10 to about 18 carbon atoms. More preferably the hydrocarbyl chain length for liquid compositions is from about 16 to about 18 carbon atoms and for solid compositions from about 10 to about 14 carbon atoms. In the general formula for the ethoxylated nonionic surfactants herein, Y is typically —O—, —C(O)O—, —C(O)N(R)—, or —C(O)N(R)R—, in which $R^2$, and R, when present, have the meanings given hereinbefore, and/or R can be hydrogen, for solid compositions z is at least about 8, preferably at least about 10–11, more preferably at least about 15; for liquid compositions z is at least about 10–11, preferably at least about 15. Performance and, usually, stability of the softener composition decrease when fewer ethoxylate groups are present.

The nonionic surfactants herein are characterized by an HLB (hydrophilic-lipophilic balance) of from about 7 to about 20, preferably from about 8 to about 15. Of course, by defining $R^2$ and the number of ethoxylate groups, the HLB of the surfactant is, in general, determined. However, it is to be noted that the nonionic ethoxylated surfactants useful herein, for concentrated liquid compositions, contain relatively long chain $R^2$ groups and are relatively highly ethoxylated. While shorter alkyl chain surfactants having short ethoxylated groups may possess the requisite HLB, they are not as effective herein.

Nonionic surfactants as the viscosity/dispersibility modifiers are preferred over the other modifiers disclosed herein for compositions with higher levels of perfume.

Examples of nonionic surfactants follow. The nonionic surfactants of this invention are not limited to these examples. In the examples, the integer defines the number of ethoxyl (EO) groups in the molecule.

A. Straight-Chain, Primary Alcohol Alkoxylates

The deca-, undeca-, dodeca-, tetradeca-, and pentadeca-ethoxylates of n-hexadecanol, and n-octadecanol having an HLB within the range recited herein are useful viscosity/dispersibility modifiers in the context of this invention. Exemplary ethoxylated primary alcohols useful herein as the viscosity/dispersibility modifiers of the compositions are n-$C_{18}$EO(10); and n-$C_{10}$EO(11). The ethoxylates of mixed natural or synthetic alcohols in the "tallow" chain length range are also useful herein. Specific examples of such materials include tallow-alcohol-EO( 11), tallowalcohol-EO(18), and tallowalcohol -EO (25).

B. Straight-Chain, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having and HLB within the range recited herein are useful viscosity/dispersibility modifiers in the context of this invention. Exemplary ethoxylated secondary alcohols useful herein as the viscosity/dispersibility modifiers of the compositions are: 2-$C_{16}$EO(11); 2-$C_{20}$EO(11); and 2-$C_{16}$EO(14).

C. Alkyl Phenol Alkoxylates

As in the case of the alcohol alkoxylates, the hexa- through octadeca-ethoxylates of alkylated phenols, particularly monohydric alkylphenols, having an HLB within the range recited herein are useful as the viscosity/dispersibility modifiers of the instant compositions. The hexa- through octadeca-ethoxylates of p-tri-decylphenol, m-pentadecylphenol, and the like, are useful herein. Exemplary ethoxylated alkylphenols useful as the viscosity/dispersibility modifiers of the mixtures herein are: p-tridecylphenol EO(11) and p-pentadecylphenol EO(18).

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

D. Olefinic Alkoxylates

The alkenyl alcohols, both primary and secondary, and alkenyl phenols corresponding to those disclosed immediately hereinabove can be ethoxylated to an HLB within the range recited herein and used as the viscosity/dispersibility modifiers of the instant compositions.

E. Branched Chain Alkoxylates

Branched chain primary and secondary alcohols which are available from the well-known "OXO" process can be ethoxylated and employed as the viscosity/dispersibility modifiers of compositions herein.

The above ethoxylated nonionic surfactants are useful in the present compositions alone or in combination, and the term "nonionic surfactant" encompasses mixed nonionic surface active agents.

(B)(3) Mixtures

The term "mixture" includes the nonionic surfactant and the single-long-chain-alkyl cationic surfactant added to the composition in addition to any monoester present in the DEQA.

Mixtures of the above viscosity/dispersibility modifiers are highly desirable. The single long chain cationic surfactant provides improved dispersibility and protection for the primary DEQA against anionic surfactants and/or detergent builders that are carried over from the wash solution.

Mixtures of the viscosity/dispersibility modifiers are present for solid compositions at a level of from about 3% to about 30%, preferably from about 5% to about 20%, and for liquid compositions at a level of from about 0.1% to about 30%, preferably from about 0.2% to about 20%, by weight of the composition.

III. Low Viscosity Premix Composition Containing Diester Quaternary Ammonium Compound and Premix Fluidizers The premix composition of the present invention consists essentially of DEQA, optionally, a viscosity and/or dispersibility modifier, and a required premix fluidizer. The molten premix is used to either form a solid by cooling and/or by solvent removal or to form the concentrated liquids by, e.g., injection into the aqueous liquid carrier, preferably with high shear.

It can be advantageous to use an effective amount of a fluidizer in the DEQA molten premix in formulating the compositions, especially the concentrated aqueous liquid compositions, of the present invention. Preferably the viscosity of the premix should be about 10,000 cps or less, preferably about 4,000 cps or less, more preferably about 2,000 cps or less. The temperature of the molten premix is about 100° C. or less, preferably about 95° C. or less, more preferably about 85° C. or less.

Useful premix fluidizers include those selected from the group consisting of:

1. from about 1% to about 15%, preferably from about 2% to about 10% of linear fatty monoesters, such as fatty acid esters of low molecular weight alcohols, having a ratio to DEQA of from about 1:5 to about 1:100, preferably from about 1:10 to about 1:50;

2. from about 2% to about 25%, preferably from about 4% to about 15%, of short chain ($C_1$–$C_3$) alcohols having a ratio to DEQA of from about 1:3 to about 1:50, preferably from about 1:5 to about 1:25;

3. from about 1% to about 40%, preferably from about 2% to about 30%, of di-substituted imidazoline ester softening compounds having a ratio to DEQA of from about 2:3 to about 1:100, preferably from about 1:2 to about 1:50;

4. from about 1% to about 20%, preferably from about 2% to about 10%, of fatty alkyl imidazoline or imidazoline alcohols, having a ratio to DEQA of from about 1:4 to about 1:100, preferably from about 1:8 to about 1:50;

5. from about 1% to about 40%, preferably from about 2% to about 25%, of $C_{10}$–$C_{22}$ di-long-chain amines, di-long-chain ester amines, mono-long-chain amines, mono-long-chain ester amines, alkylene polyammonium salts (e.g., lysine and 1,5-diammonium 2-methyl pentane dihydrochloride), and/or amine oxides. These have a ratio to DEQA of from about 1:2 to about 1:100, preferably from about 1:4 to about 1:50;

6. from about 1% to about 25%, preferably from about 2% to about 10%, of $C_{10}$–$C_{22}$ alkyl or alkenyl succinic anhydrides or acids and/or $C_{10}$–$C_{22}$ long-chain fatty alcohols and fatty acids. These have a ratio to DEQA of from about 1:3 to about 1:100, preferably from about 1:10 to about 1:50; and 7. mixtures thereof.

Preferably the premix fluidizers are selected from the group consisting of 1, 3, 4, and mixtures thereof.

Short chain alcohols (low molecular weight alcohols), fatty alcohols, and fatty acids, mixed with DEQA and a viscosity and/or dispersibility modifier will produce fluid premix compositions, but these components are not preferred for stable, concentrated liquid products. More preferably, the concentrated aqueous liquid compositions of the present invention should be substantially free of low molecular weight alcohols, fatty alcohols, and fatty acids, for improved stability.

Linear fatty monoesters, discussed hereinbefore in more detail, can be added to the DEQA premix as fluidizers. An example of a DEQA premix fluidizer is methyltallowate.

As discussed hereinbefore, as a raw material, DEQA comprises a small percentage of monoester. Monoester can be formed by either incomplete esterification or by hydrolyzing a small amount of DEQA and thereafter extracting the fatty acid by-product. These monoesters can also function as premix fluidizers. Preferably, the compositions of the present invention are essentially free of the monoester of Formula II. Preferably the composition of the present invention comprises less than about 5%, preferably less than about 1%, of DEQA monoester of Formula I. Generally, the composition of the present invention should only have low levels of, and preferably is substantially free of, free fatty acid by-product or free fatty acids from other sources because it inhibits effective processing of the composition. The level of free fatty acid in the compositions of the present invention is less than about 5%, preferably less than about 3%, more preferably less than about 1% by weight.

Di-substituted imidazoline ester softening compounds, imidazoline alcohols, and monotallow trimethyl ammonium chloride are discussed hereinbefore and hereinafter.

(C) Optional Ingredients

In addition to the above components, the composition can have one or more of the following optional ingredients.

(1) Liquid Carrier

The liquid carrier employed in the instant compositions is preferably water due to its low cost relative availability, safety, and environmental compatibility. The level of water in the liquid carrier is more than about 50%, preferably more than about 80%, more preferably more than about 85%, by weight of the carrier. The level of liquid carrier is greater than about 50%, preferably greater than about 65%, more preferably greater than about 70%. Mixtures of water and low molecular weight, e.g., <100, organic solvent, e.g., lower alcohol such as ethanol, propanol, isopropanol or butanol are useful as the carrier liquid. Low molecular weight alcohols include monohydric, dihydric (glycol, etc.) trihydric (glycerol, etc.), and polyhydric (polyols) alcohols.

(2) Essentially Linear Fatty Acid and/or Fatty Alcohol Monoesters

Optionally, an essentially linear fatty monoester can be added in the composition of the present invention and is often present in at least a small amount as a minor ingredient in the DEQA raw material.

Monoesters of essentially linear fatty acids and/or alcohols, which aid said modifier, contain from about 12 to about 25, preferably from about 13 to about 22, more preferably from about 16 to about 20, total carbon atoms, with the fatty moiety, either acid or alcohol, containing from about 10 to about 22, preferably from about 12 to about 18, more preferably from about 16 to about 18, carbon atoms. The shorter moiety, either alcohol or acid, contains from about 1 to about 4, preferably from about 1 to about 2, carbon atoms. Preferred are fatty acid esters of lower alcohols, especially methanol. These linear monoesters can be added to a DEQA premix as a premix fluidizer, and/or added to aid the viscosity/dispersibility modifier in the processing of the softener composition.

(3) Optional Nonionic Softener

An optional additional softening agent of the present invention is a nonionic fabric softener material. Typically, such nonionic fabric softener materials have an HLB of from about 2 to about 9, more typically from about 3 to about 7. Such nonionic fabric softener materials tend to be readily dispersed either by themselves, or when combined with other materials such as single-long-chain alkyl cationic surfactant described in detail hereinbefore. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g., >~50° C.) and relatively water-insoluble.

The level of optional nonionic softener in the solid composition is typically from about 10% to about 40%, preferably from about 15% to about 30%, and the ratio of the optional nonionic softener to DEQA is from about 1:6 to about 1:2, preferably from about 1:4 to about 1:2. The level of optional nonionic softener in the liquid composition is typically from about 0.5% to about 10%, preferably from about 1% to about 5%.

Preferred nonionic softeners are fatty acid partial esters of polyhydric alcohols, or anhydrides thereof, wherein the alcohol, or anhydride, contains from 2 to about 18, preferably from 2 to about 8, carbon atoms, and each fatty acid moiety contains from about 12 to about 30, preferably from about 16 to about 20, carbon atoms. Typically, such softeners contain from about one to about 3, preferably about 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters and polyglycerol monostearate are particularly preferred. Glycerol monostearate, having a low HLB, has a detrimental effect on stability of the compositions of the present invention.

The fatty acid portion of the ester is normally derived from fatty acids having from about 12 to about 30, preferably from about 16 to about 20, carbon atoms, typical examples of said fatty acids being lauric acid, myristic acid, palmitic acid, stearic acid and behenic acid.

Highly preferred optional nonionic softening agents for use in the present invention are the sorbitan esters, which are esterified dehydration products of sorbitol, and the glycerol esters.

Sorbitol, which is typically prepared by the catalytic hydrogenation of glucose, can be dehydrated in well known fashion to form mixtures of 1,4- and 1,5-sorbitol anhydrides and small amounts of isosorbides. (See U.S. Pat. No. 2,322,821, Brown, issued June 29, 1943, incorporated herein by reference.)

The foregoing types of complex mixtures of anhydrides of sorbitol are collectively referred to herein as "sorbitan." It will be recognized that this "sorbitan" mixture will also contain some free, uncyclized sorbitol.

The preferred sorbitan softening agents of the type employed herein can be prepared by esterifying the "sorbitan" mixture with a fatty acyl group in standard fashion, e.g., by reaction with a fatty acid halide or fatty acid. The esterification reaction can occur at any of the available hydroxyl groups, and various mono-, di-, etc., esters can be prepared. In fact, mixtures of mono-, di-, tri-, etc., esters almost always result from such reactions, and the stoichiometric ratios of the reactants can be simply adjusted to favor the desired reaction product.

For commercial production of the sorbitan ester materials, etherification and esterification are generally accomplished in the same processing step by reacting sorbitol directly with fatty acids. Such a method of sorbitan ester preparation is described more fully in MacDonald; "Emulsifiers:" Processing and Quality Control:, *Journal of the American Oil Chemists' Society,* Vol. 45, October 1968.

Details, including formula, of the preferred sorbitan esters can be found in U.S. Pat. No. 4,128,484, incorporated hereinbefore by reference.

Certain derivatives of the preferred sorbitan esters herein, especially the "lower" ethoxylates thereof (i.e., mono-, di-, and tri-esters wherein one or more of the unesterified —OH groups contain one to about twenty oxyethylene moieties [Tweens®] are also useful in the composition of the present invention. Therefore, for purposes of the present invention, the term "sorbitan ester" includes such derivatives.

For the purposes of the present invention, it is preferred that a significant amount of di- and tri- sorbitan esters are present in the ester mixture. Ester mixtures having from 20–50% mono-ester, 25–50% di-ester and 10–35% of tri- and tetra-esters are preferred.

The material which is sold commercially as sorbitan monoester (e.g., monostearate) does in fact contain significant amounts of di- and tri-esters and a typical analysis of sorbitan monostearate indicates that it comprises ca. 27% mono-, 32% di- and 30% tri- and tetra-esters. Commercial sorbitan monostearate therefore is a preferred material. Mixtures of sorbitan stearate and sorbitan palmitate having stearate/palmitate weight ratios varying between 10:1 and 1:10, and 1,5-sorbitan esters are useful. Both the 1,4- and 1,5-sorbitan esters are useful herein.

Other useful alkyl sorbitan esters for use in the softening compositions herein include sorbitan monolaurate, sorbitan monomyristate, sorbitan monopalmitate, sorbitan monobehenate, sorbitan monooleate, sorbitan dilaurate, sorbitan dimyristate, sorbitan dipalmitate, sorbitan distearate, sorbitan dibehenate, sorbitan dioleate, and mixtures thereof, and mixed tallowalkyl sorbitan mono- and di-esters. Such mixtures are readily prepared by reacting the foregoing hydroxy-substituted sorbitans, particularly the 1,4- and 1,5-sorbitans, with the corresponding acid or acid chloride in a simple esterification reaction. It is to be recognized, of course, that commercial materials prepared in this manner will comprise mixtures usually containing minor proportions of uncyclized sorbitol, fatty acids, polymers, isosorbide structures, and the like. In the present invention, it is preferred that such impurities are present at as low a level as possible.

The preferred sorbitan esters employed herein can contain up to about 15% by weight of esters of the $C_{20}$–$C_{26}$, and higher, fatty acids, as well as minor amounts of $C_8$, and lower, fatty esters.

Polyglycerol esters, especially diglycerol, triglycerol, and polyglycerol mono- and/or di- esters, preferably mono-, are also preferred herein (e.g., polyglycerol monostearate with a trade name of Radiasurf 7248). Polyglycerol esters can be prepared from naturally occurring triglycerides by normal extraction, purification and/or interesterification processes or by esterification processes of the type set forth hereinbefore for sorbitan esters. Partial esters of glycerin can also be ethoxylated to form usable derivatives that are included within the term "glycerol esters."

Useful polyglycerol esters include mono-esters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "polyglycerol esters" also include polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

Preferably the compositions of the present invention are essentially free of glycerol monostearate (GMS). Because GMS has a lower HLB and is too hydrophobic, it causes phase separation and/or stability problems in the compositions of the present invention.

The performance of, e.g., polyglycerol monoesters is improved by the presence of the diester cationic material, described hereinbefore.

Still other desirable optional "nonionic" softeners are ion pairs of anionic detergent surfactants and fatty amines, or quaternary ammonium derivatives thereof, e.g., those disclosed in U.S. Pat. No. 4,756,850, Nayar, issued Jul. 12, 1988, said patent being incorporated herein by reference. These ion pairs act like nonionic materials since they do not readily ionize in water. They typically contain at least two long hydrophobic groups (chains).

The ion-pair complexes can be represented by the following formula:

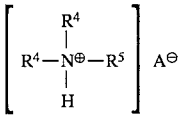

wherein each $R^4$ can independently be $C_{12}$–$C_{20}$ alkyl or alkenyl, and $R^5$ is H or $CH_3$. $A^{\ominus}$ represents an anionic compound and includes a variety of anionic surfactants, as well as related shorter alkyl chain compounds which need not exhibit surface activity. $A^-$ is selected from the group consisting of alkyl sulfonates, aryl sulfonates, alkylaryl sulfonates, alkyl sulfates, dialkyl sulfosuccinates, alkyl oxybenzene sulfonates, acyl isethionates, acylalkyl taurates, alkyl ethoxylated sulfates, olefin sulfonates, preferably benzene sulfonates, and $C_1$–$C_5$ linear alkyl benzene sulfonates, or mixtures thereof.

The terms "alkyl sulfonate" and "linear alkyl benzene sulfonate" as used herein shall include alkyl compounds having a sulfonate moiety both at a fixed location along the carbon chain, and at a random position along the carbon chain. Starting alkylamines are of the formula:

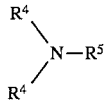

wherein each $R^4$ is $C_{12}$–$C_{20}$ alkyl or alkenyl, and $R^5$ is H or $CH_3$.

The anionic compounds ($A^-$) useful in the ion-pair complex of the present invention are the alkyl sulfonates, aryl sulfonates, alkylaryl sulfonates, alkyl sulfates, alkyl ethoxylated sulfates, dialkyl sulfosuccinates, ethoxylated alkyl sulfonates, alkyl oxybenzene sulfonates, acyl isethionates, acylalkyl taurates, and paraffin sulfonates.

The preferred anions ($A^{\ominus}$) useful in the ion-pair complex of the present invention include benzene sulfonates and $C_1$–$C_5$ linear alkyl benzene sulfonates (LAS), particularly $C_1$–$C_3$ LAS. Most preferred is $C_3$ LAS. The benzene sulfonate moiety of LAS can be positioned at any carbon atom of the alkyl chain, and is commonly at the second atom for alkyl chains containing three or more carbon atoms.

More preferred are complexes formed from the combination of ditallow amine (hydrogenated or unhydrogenated) complexed with a benzene sulfonate or $C_1$–$C_5$ linear alkyl benzene sulfonate and distearyl amine complexed with a benzene sulfonate or with a $C_1$–$C_5$ linear alkyl benzene sulfonate. Even more preferred are those complexes formed from hydrogenated ditallow amine or distearyl amine complexed with a $C_1$–$C_3$ linear alkyl benzene sulfonate (LAS). Most preferred are complexes formed from hydrogenated ditallow amine or distearyl amine complexed with $C_3$ linear alkyl benzene sulfonate.

The amine and anionic compound are combined in a molar ratio of amine to anionic compound ranging from about 10:1 to about 1:2, preferably from about 5:1 to about 1:2, more preferably from about 2:1 to about 1:2, and most preferably 1:1. This can be accomplished by any of a variety of means, including but not limited to, preparing a melt of the anionic compound (in acid form) and the amine, and then processing to the desired particle size range.

A description of ion-pair complexes, methods of making, and non-limiting examples of ion-pair complexes and starting amines suitable for use in the present invention are listed in U.S. Pat. No. 4,915,854, Mao et al., issued April 10, 1990, and U.S. Pat. No. 5,019,280, Caswell et al., issued May 28, 1991, both patents incorporated herein by reference.

Generically, the ion pairs useful herein are formed by reacting an amine and/or a quaternary ammonium salt containing at least one, and preferably two, long hydrophobic chains ($C_{12}$–$C_{30}$, preferably $C_{11}$–$C_{20}$) with an anionic detergent surfactant of the types disclosed in said U.S. Pat. No. 4,756,850, especially at Col. 3, lines 29–47. Suitable methods for accomplishing such a reaction are also described in U.S. Pat. No. 4,756,850, at Col. 3, lines 48–65.

The equivalent ion pairs formed using $C_{12}$–$C_{30}$ fatty acids are also desirable. Examples of such materials are known to be good fabric softeners as described in U.S. Pat. No. 4,237,155, Kardouche, issued Dec. 2, 1980, said patent being incorporated herein by reference.

Other fatty acid partial esters useful in the present invention are ethylene glycol distearate, propylene glycol distearate, xylitol monopalmitate, pentaerythritol monostearate, sucrose monostearate, sucrose distearate, and glycerol monostearate. As with the sorbitan esters, commercially available mono-esters normally contain substantial quantities of di- or tri- esters.

Still other suitable nonionic fabric softener materials include long chain fatty alcohols and/or acids and esters thereof containing from about 16 to about 30, preferably from about 18 to about 22, carbon atoms, esters of such compounds with lower ($C_1$–$C_4$) fatty alcohols or fatty acids, and lower (1–4) alkoxylation ($C_1$–$C_4$) products of such materials.

These other fatty acid partial esters, fatty alcohols and/or acids and/or esters thereof, and alkoxylated alcohols and those sorbitan esters which do not form optimum emulsions/dispersions can be improved by adding other di-long-chain cationic material, as disclosed hereinbefore and hereinafter, or other nonionic softener materials to achieve better results.

The above-discussed nonionic compounds are correctly termed "softening agents," because, when the compounds are correctly applied to a fabric, they do impart a soft, lubricious feel to the fabric. However, they require a cationic material if one wishes to efficiently apply such compounds from a dilute, aqueous rinse solution to fabrics. Good deposition of the above compounds is achieved through their combination with the cationic softeners discussed hereinbefore and hereinafter. The fatty acid partial ester materials are preferred for biodegradability and the ability to adjust the HLB of the nonionic material in a variety of ways, e.g., by varying the distribution of fatty acid chain lengths, degree of saturation, etc., in addition to providing mixtures.

(C)(4) Optional Imidazoline Softening Compound

Optionally, the solid composition of the present invention contains from about 1% to about 30%, preferably from about 5% to about 20%, and the liquid composition contains from about 1% to about 20%, preferably from about 1% to about 15%, of a di-substituted imidazoline softening compound of the formula:

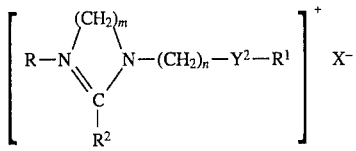

(I)

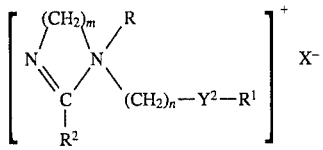

(II)

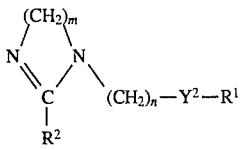

(III)

or mixtures thereof, wherein $Y^2$ is as defined hereinbefore; $R^1$ and $R^2$ are, independently, a $C_{11}$–$C_{21}$ hydrocarbyl group, preferably a $C_{13}$–$C_{17}$ alkyl group, most preferably a straight chained tallow alkyl group; R is a $C_1$–$C_4$ hydrocarbyl group, preferably a $C_1$–$C_3$ alkyl, alkenyl or hydroxyalkyl group, e.g., methyl (most preferred), ethyl, propyl, propenyl, hydroxyethyl, 2-, 3-di-hydroxypropyl and the like; and m and n are, independently, from about 2 to about 4, preferably about 2. The counterion $X^-$ can be any softener compatible anion, for example, chloride, bromide, methylsulfate, ethylsulfate, formate, sulfate, nitrate, and the like.

The above compounds can optionally be added to the composition of the present invention as a DEQA premix fluidizer or added later in the composition's processing for their softening, scavenging, and/or antistatic benefits. When these compounds are added to DEQA premix as a premix fluidizer, the compound's ratio to DEQA is from about 2:3 to about 1:100, preferably from about 1:2 to about 1:50.

Compounds (I) and (II) can be prepared by quaternizing a substituted imidazoline ester compound. Quaternization may be achieved by any known quaternization method. A preferred quaternization method is disclosed in U.S. Pat. No. 4,954,635, Rosario-Jansen et al., issued Sep. 4, 1990, the disclosure of which is incorporated herein by reference.

The di-substituted imidazoline compounds contained in the compositions of the present invention are believed to be biodegradable and susceptible to hydrolysis due to the ester group on the alkyl substituent. Furthermore, the imidazoline compounds contained in the compositions of the present invention are susceptible to ring opening under certain conditions. As such, care should be taken to handle these compounds under conditions which avoid these consequences. For example, stable liquid compositions herein are preferably formulated at a pH in the range of about 1.5 to about 5.0, most preferably at a pH ranging from about 1.8 to 3.5. The pH can be adjusted by the addition of a Bronsted acid. Examples of suitable Bronsted acids include the inorganic mineral acids, carboxylic acids, in particular the low molecular weight ($C_1$–$C_5$) carboxylic acids, and alkylsulfonic acids. Suitable organic acids include formic, acetic, benzoic, methylsulfonic and ethylsulfonic acid. Preferred acids are hydrochloric and phosphoric acids. Additionally, compositions containing these compounds should be maintained substantially free of unprotonated, acyclic amines.

In many cases, it is advantageous to use a 3-component composition comprising: (B) a viscosity/dispersibility modifier, e.g., mono-long-chain alkyl cationic surfactant such as fatty acid choline ester, cetyl or tallow alkyl trimethylammonium bromide or chloride, etc., a nonionic surfactant, or mixtures thereof; (A) a diester quaternary ammonium cationic softener such as di(tallowoyloxy ethyl) dimethylammonium chloride; and (C)(4) a di-long-chain imidazoline ester compound in place of some of the DEQA. The additional di-long-chain imidazoline ester compound, as well as providing additional softening and, especially, antistatic benefits, also acts as a reservoir of additional positive charge, so that any anionic surfactant which is carried over into the rinse solution from a conventional washing process is effectively neutralized.

(C)(5) Optional, but Highly Preferred, Soil Release Agent

Optionally, the compositions herein contain from 0% to about 10%, preferably from about 0.1% to about 5%, more preferably from about 0.1% to about 2%, of a soil release agent. Preferably, such a soil release agent is a polymer. Polymeric soil release agents useful in the present invention include copolymeric blocks of terephthalate and polyethylene oxide or polypropylene oxide, and the like. These agents give additional stability to the concentrated aqueous, liquid compositions. Therefore, .their presence in such liquid compositions, even at levels which do not provide soil release benefits, is preferred.

A preferred soil release agent is a copolymer having blocks of terephthalate and polyethylene oxide. More specifically, these polymers are comprised of repeating units of ethylene and/or propylene terephthalate and polyethylene oxide terephthalate at a molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commmercially available materials Zelcon® 4780 (from DuPont) and Milease® T (from ICI).

Highly preferred soil release agents are polymers of the generic formula:

$$X-(OCH_2CH_2)_n(O-\overset{\overset{\displaystyle O}{\|}}{C}-R^1-\overset{\overset{\displaystyle O}{\|}}{C}-OR^2)_u(O-\overset{\overset{\displaystyle O}{\|}}{C}-R^1-\overset{\overset{\displaystyle O}{\|}}{C}-O)(CH_2CH_2O)_n-X$$

in which X can be any suitable capping group, with each X being selected from the group consisting of H, and alkyl or acyl groups containing from about 1 to about 4 carbon atoms, preferably methyl. n is selected for water solubility and generally is from about 6 to about 113, preferably from about 20 to about 50. u is critical to formulation in a liquid composition having a relatively high ionic strength. There should be very little material in which u is greater than 10. Furthermore, there should be at least 20%, preferably at least 40%, of material in which u ranges from about 3 to about 5.

The $R^1$ moieties are essentially 1,4-phenylene moieties. As used herein, the term "the $R^1$ moieties are essentially 1,4-phenylene moieties" refers to compounds where the $R^1$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene, 1,8-naphthylene, 1,4-naphthylene, 2,2-biphenylene, 4,4-biphenylene and mixtures thereof. Alkylene and alkenylene moieties which can be partially substituted include ethylene, 1,2-propylene, 1,4-butylene, 1,5-pentylene, 1,6-hexamethylene, 1,7-heptamethylene, 1,8-octamethylene, 1,4-cyclohexylene, and mixtures thereof.

For the $R^1$ moieties, the degree of partial substitution with moieties other than 1,4-phenylene should be such that the soil release properties of the compound are not adversely affected to any great extent. Generally, the degree of partial substitution which can be tolerated will depend upon the backbone length of the compound, i.e., longer backbones can have greater partial substitution for 1,4-phenylene moieties. Usually, compounds where the $R^1$ comprise from about 50% to about 100% 1,4-phenylene moieties (from 0 to about 50% moieties other than 1,4-phenylene) have adequate soil release activity. For example, polyesters made according to the present invention with a 40:60 mole ratio of isophthalic (1,3-phenylene) to terephthalic (1,4-phenylene) acid have adequate soil release activity. However, because most polyesters used in fiber making comprise ethylene terephthalate units, it is usually desirable to minimize the degree of partial substitution with moieties other than 1,4-phenylene for best soil release activity. Preferably, the $R^1$ moieties consist entirely of (i.e., comprise 100%) 1,4-phenylene moieties, i.e., each $R^1$ moiety is 1,4-phenylene.

For the $R^2$ moieties, suitable ethylene or substituted ethylene moieties include ethylene, 1,2-propylene, 1,2-butylene, 1,2-hexylene, 3-methoxy-1,2-propylene and mixtures thereof. Preferably, the $R^2$ moieties are essentially ethylene moieties, 1,2-propylene moieties or mixture thereof. Inclusion of a greater percentage of ethylene moieties tends to improve the soil release activity of compounds. Surprisingly, inclusion of a greater percentage of 1,2-propylene moieties tends to improve the water solubility of the compounds.

Therefore, the use of 1,2-propylene moieties or a similar branched equivalent is desirable for incorporation of any substantial part of the soil release component in the liquid fabric softener compositions. Preferably, from about 75% to about 100%, more preferably from about 90% to about 100%, of the $R^2$ moieties are 1,2-propylene moieties.

The value for each n is at least about 6, and preferably is at least about 10. The value for each n usually ranges from about 12 to about 113. Typically, the value for each n is in the range of from about 12 to about 43.

A more complete disclosure of these highly preferred soil release agents is contained in European Patent Application 185,427, Gosselink, published Jun. 25, 1986, incorporated herein by reference.

(C)(6) Optional Bacteriocides

Examples of bacteriocides used in the compositions of this invention are glutaraldehyde, formaldehyde, 2-bromo-2-nitropropane-1,3-diol sold by Inolex Chemicals under the trade name Bronopol®, and a mixture of 5-chloro-2-methyl-4-isothiazolin-3-one and 2-methyl-4-isothiazoline-3-one sold by Rohm and Haas Company under the trade name Kathon® CG/ICP. Typical levels of bacteriocides used in the present compositions are from about 1 to about 1,000 ppm by weight of the composition.

Examples of antioxidants that can be added to the compositions of this invention are propyl gallate, available from Eastman Chemical Products, Inc., under the trade names Tenox® PG and Tenox S-1, and butylated hydroxy toluene, available from UOP Process Division under the trade name Sustane® BHT.

(7) Other Optional Ingredients

Inorganic viscosity control agents such as water-soluble, ionizable salts can also optionally be incorporated into the compositions of the present invention. A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 10,000 parts per million (ppm), preferably from about 20 to about 4,000 ppm, by weight of the composition.

Alkylene polyammonium salts can be incorporated into the composition to give viscosity control in addition to or in place of the water-soluble, ionizable salts above. In addition, these agents can act as scavengers, forming ion pairs with anionic detergent carried over from the main wash, in the rinse, and on the fabrics, and may improve softness performance. These agents may stabilize the viscosity over a broader range of temperature, especially at low temperatures, compared to the inorganic electrolytes.

Specific examples of alkylene polyammonium salts include 1-lysine monohydrochloride and 1,5-diammonium 2-methyl pentane dihydrochloride.

The present invention can include other optional components conventionally used in textile treatment compositions, for example, colorants, perfumes, preservatives, optical brighteners, opacifiers, fabric conditioning agents, surfactants, stabilizers such as guar gum and polyethylene glycol, anti-shrinkage agents, anti-wrinkle agents, fabric crisping agents, spotting agents, germicides, fungicides, antioxidants such as butylated hydroxy toluene, anti-corrosion agents, and the like.

In the method aspect of this invention, fabrics or fibers are contacted with an effective amount, generally from about 10 ml to about 150 ml (per 3.5 kg of fiber or fabric being treated) of the softener actives (including DEQA) herein in an aqueous bath. Of course, the amount used is based upon the judgment of the user, depending on concentration of the composition, fiber or fabric type, degree of softness desired, and the like. Preferably, the rinse bath contains from about 10 to about 1,000 ppm, preferably from about 50 to about 500 ppm, of the DEQA fabric softening compounds herein.

I. Solid Fabric Softener Compositions

As discussed hereinbefore, solid fabric softener compositions of the present invention contain from about 50% to about 95%, preferably from about 60% to about 90% of (A) the diester quaternary ammonium compound. Levels of (B)(1) single-long-chain alkyl cationic surfactants as the viscosity/dispersibility modifier are from 0% to about 15%, preferably from about 3% to about 15%, more preferably from about 5% to about 15%, by weight of the compositions. Levels of (B)(2) nonionic surfactants are from about 5% to about 20%, preferably from about 8% to about 15%, by weight of the composition. Mixtures (B)(3) of these agents at a level of from about 3% to about 30%, preferably from about 5% to about 20%, by weight of the composition, can also effectively serve as viscosity/dispersibility modifiers.

The optimal degree of ethoxylation and hydrocarbyl chain length of the nonionic surfactant for a binary system (DEQA and nonionic surfactant (B)(2)) is $C_{10-14}$ $E_{10-18}$.

In solid compositions the low molecular weight alcohol level is less than about 4%, preferably less than about 3%. Levels of electrolyte to provide the levels for concentrated liquid compositions, as described hereinbefore, are desirably present in any solid composition used to form concentrated liquid compositions.

The granules can be formed by preparing a melt, solidifying it by cooling, and then grinding and sieving to the desired size. It is highly preferred that the primary particles of the granules have a diameter of from about 50 to about 1,000, preferably from about 50 to about 400, more preferably from about 50 to about 200, microns. The granules can comprise smaller and larger particles, but preferably from about 85% to about 95%, more preferably from about 95% to about 100%, are within the indicated ranges. Smaller and larger particles do not provide optimum emulsions/dispersions when added to water. Other methods of preparing the primary particles can be used including spray cooling of the melt. The primary particles can be agglomerated to form a dust-free, non-tacky, free-flowing powder. The agglomeration can take place in a conventional agglomeration unit (i.e., Zig-Zag Blender, Lodige) by means of a water-soluble binder. Examples of water-soluble binders useful in the above agglomeration process include glycerol, polyethylene glycols, polymers such as PVA, polyacrylates, and natural polymers such as sugars.

The flowability of the granules can be improved by treating the surface of the granules with flow improvers such as clay, silica or zeolite particles, water-soluble inorganic salts, starch, etc.

In a three-component mixture, e.g., nonionic surfactant, single-long-chain cationic, and DEQA, it is more preferred, when forming the granules, to pre-mix the nonionic surfactant and the more soluble single-long-chain alkyl cationic compound before mixing in a melt of the diester quaternary ammonium cationic compound.

II. Concentrated Liquid Fabric Softener Compositions

Also, as discussed hereinbefore, concentrated liquid fabric softener compositions of the present invention contain from about 15% to about 50%, preferably from about 15% to about 35%, more preferably from about 15% to about 30%, by weight of the composition, of (A) diester quaternary ammonium fabric softening compound. Levels of (B)(2) nonionic surfactants as the viscosity/dispersibility modifier are from 0% to about 5%, preferably from about 0.1% to about 5%, more preferably from about 0.2% to about 3%, by weight of the composition. Levels of (B)(1) single-long-chain cationic surfactants are from 0% to about 15%, preferably from about 0.5% to about 10%, by weight of the composition. Mixtures of these agents (B)(3) at a level of from about 0.1% to about 30%, preferably from about 0.2% to about 20%, can also effectively serve as the viscosity/dispersibility modifier. The optimal degree of ethoxylation and hydrocarbyl chain length of the nonionic surfactant (B)(2) for a binary system (DEQA and nonionic) is $C_{16-18}$ $E_{10-11}$, and for a ternary system (DEQA, nonionic, and optional nonionic softener, e.g., polyglycerol monostearate) is $C_{16-18}$ $E_{25}$.

Liquid Fabric Softener Compositions Made from Solid Compositions

The solid composition I of the present invention can be mixed with water to form dilute or II concentrated liquid softener compositions, II, having a concentration of from about 5% to about 50%, preferably from about 5% to about 35%, more preferably from about 5% to about 30%, of diester quaternary ammonium fabric softening compound. The water temperature for preparation should be from about 20° C. to about 90° C., preferably from about 25° C. to about 80° C. Single-long-chain alkyl cationic surfactants as the viscosity/dispersibility modifier at a level of from 0% to about 15%, preferably from about 3% to about 15%, more preferably from about 5% to about 15%, by weight of the composition, are preferred for the solid composition. Nonionic surfactants at a level of from about 5% to about 20%, preferably from about 8% to about 15%, as well as mixtures of these agents can also serve effectively as the viscosity/dispersibility modifier.

The emulsified/dispersed particles, formed when the said granules are added to water to form aqueous concentrates, typically have an average particle size of less than about 10 microns, preferably less than about 2 microns, and more preferably from about 0.2 to about 2 microns, in order that effective deposition onto fabrics is achieved. The term "average particle size," in the context of this specification, means a number average particle size, i.e., more than 50% of the particles have a diameter less than the specified size.

Particle size for the emulsified/dispersed particles is determined using, e.g., a Malvern particle size analyzer.

Depending upon the particular selection of nonionic and cationic surfactant, it may be desirable in certain cases, when using the solids to prepare the liquid, to employ an efficient means for dispersing and emulsifying the particles (e.g., blender).

Solid particulate compositions used to make liquid compositions may, optionally, contain electrolytes, perfume, antifoam agents, flow aids (e.g., silica), dye, preservatives, and/or other optional ingredients described hereinbefore.

The benefits of adding water to the particulate solid composition to form aqueous compositions include the ability to transport less weight thereby making shipping more economical, and the ability to form liquid compositions with lower energy input (i.e., less shear and/or lower temperature).

In the specification and examples herein, all percentages, ratios and parts are by weight unless otherwise specified and all numerical limits are normal approximations.

The following examples illustrate, but do not limit, the present invention.

EXAMPLE I

| Influence of Solvent and Choline Ester on DEQA Dispersion Viscosity | | | |
|---|---|---|---|
| DEQA[1] Wt. % | Coconut Choline Ester Chloride Wt. % | Solvent | Initial Viscosity (cps) |
| 15 | — | Isopropyl Alcohol | Gel |
| 20 | 2 | Isopropyl Alcohol | 784 |
| 20 | 2 | Ethanol | 150 |
| 20 | 2 | Methanol | 35 |
| 20 | 2 | None | 22 |
| 25 | 2.5 | None | 55 |
| 30 | 3 | None | 200 |
| 20 | — | None | 450 |

[1]Di(tallowoyloxyethyl)dimethyl ammonium chloride.

Dispersions contain 0.012% $CaCl_2$, 5% solvent, and the balance is water, unless noted. These compositions demonstrate the viscosity benefit of using mono-long-chain cationic surfactant with low, or no, levels of solvent.

The following compositions exhibit excellent viscosity stability over a broad range of storage temperatures.

EXAMPLE II

| Viscosity/Temperature Effects | | |
|---|---|---|
| Component | 1 Wt. % | 2 Wt. % |
| DEQA[1] | 24.5 | 17 |
| Ethoxylated Fatty Alcohol[2] | 1.5 | 1.5 |
| HCl | 0.07 | 0.035 |
| PGMS[3] | — | 4 |
| Soil Release Polymer[4] | 0.5 | 0.5 |
| $CaCl_2$ | 3,000 ppm | 3,000 ppm |
| Perfume | 0.9 | 0.9 |
| Dye (2% Solution) | 80 ppm | 80 ppm |
| Water | Balance | Balance |

[1]Di(tallowoyloxyethyl)dimethyl ammonium chloride with 10% ethanol in 1, 15% in 4, and 15% isopropanol in 2 and 3.
[2]$C_{16}$–$C_{18}$ fatty alcohol polyethoxylate(11) (HLB of 13) in 1 and 3; $C_{16}$–$C_{18}$ fatty alcohol polyethoxylates(25) in 2 and 4.
[3]Polyglycerol monostearate having a trade name of Radiasurf 248.
[4]Copolymer of ethylene oxide and terephthalate with the generic soil release formula of (C)(5) wherein each X is methyl, each n is 40, u is 4, each $R^1$ is essentially 1,4-phenylene moieties, each $R^2$ is essentially ethylene, 1,2-propylene moieties, or mixtures thereof.

| Component | 3 Wt. % | 4 Wt. % |
|---|---|---|
| DEQA[1] | 17 | 24.5 |
| Ethoxylated Fatty Alcohol[2] | 2.0 | 1.50 |
| HCl (13–25% solution) | 0.035 | 0.04 |
| PGMS[3] | 4 | 2 |
| Soil Release Polymer[4] | 0.5 | 0.33 |
| $CaCl_2$ | 3,000 ppm | — |
| Perfume | 0.9 | 0.9 |
| Dye (2% Solution) | 80 ppm | 80 ppm |
| L-Lysine Monohydrochloride | — | 0.5 |
| Water | Balance | Balance |

[1]Di(tallowoyloxyethyl)dimethyl ammonium chloride with 10% ethanol in 1, 15% in 4, and 15% isopropanol in 2 and 3.
[2]$C_{16}$–$C_{18}$ fatty alcohol with 22 ethoxylates and an HLB of 13 in 1 and 3; $C_{16}$–$C_{18}$ fatty alcohol with 25 ethoxylates in 2 and 4.
[3]Polyglycerol monostearate having a trade name of Radiasurf 7248.
[4]Copolymer of ethylene oxide and terephthalate with the generic soil release formula of (C)(5) wherein each X is methyl, each n is 40, u is 4, each $R^1$ is essentially 1,4-phenylene moieties, each $R^2$ is essentially ethylene, 1,2-propylene moieties, or mixtures thereof.

-continued

| Viscosity/Temperature Effects | | | |
|---|---|---|---|
| Component | 5 Wt. % | 6 Wt. % | 7 Wt. % |
| DEQA[1] | 24.5 | 24.5 | 24.5 |
| Ethoxylated Fatty Alcohol[2] | 1.5 | — | 1.5 |
| Tallow CE[3] | — | 2.50 | — |
| PGMS[4] | 2.0 | — | 2.0 |
| HCl (13–25% solution) | 0.04 | 0.04 | 0.04 |
| Soil Release Polymer | 0.33 | 0.50 | 0.33 |
| $CaCl_2$ | 0.40 | 0.30 | — |
| DAS[5] | — | — | 0.50 |
| Perfume | 0.90 | 0.90 | 0.90 |
| Dye (2% Solution) | 80 ppm | 80 ppm | 80 ppm |
| Water | Balance | Balance | Balance |

[1]Di(tallowoyloxyethyl)dimethyl ammonium chloride with 15% ethanol in 5 and 7, and 10% in 6.
[2]$C_{16}$–$C_{18}$ fatty alcohol with 11 ethoxylates in 7;
[3]Tallow Choline Ester with 15% isopropanol in 6.
[4]Polyglycerol monostearate having a trade name of Radiasurf 7248.
[5]Di Ammonium Salt: 1,5 diamino 2-methyl pentane dihydrochloride.

Process for Preparing 1–3

For preparing a 1500 g batch, add the ethoxylated fatty alcohol at about 50° C. (about 122° F.) to the diester quaternary ammonium compound at about 90°–95° C. (about 194°–203° F.), and mix for a few minutes. Inject this premix, in about 10 minutes, into a water seat at about 70°–72° C. (about 158°–162° F.) containing the HCl. Keep the batch at constant temperature during the injection trimming. Increase agitation from 600 rpm at the start of the premix injection to a maximum (1800 rpm) after about 6 minutes. Dye is added after ⅓ of the premix is injected. Product becomes solid after about 7 minutes. When all the premix is injected, trim the product by slowly injecting the $CaCl_2$ in about 10 minutes. Reduce the mixing speed to 1,000 rpm to avoid foam formation. Viscosity after trimming is about 50 cps. Slowly add perfume and soil release polymer under constant agitation. Viscosity rises about 10 cps (75° C.; 167° F.). Cool quickly to about 25° C. (about 77° F.). In Composition Nos. 2 and 3, the PGMS is added together with DEQA. The finished product has a viscosity between about 40 and about 70 cps at 21° C. and a pH of about 3.5–3.6.

Process for Preparing Composition 4, 5 and 7

For preparing a 1000 g batch, add the acid into the water seat at 70°–72° C. (158°–162° F.). Premix DEQA, ethoxylated fatty alcohol, and the PGMS at 80°–85° C. (176°–185° F.). Then inject this premix into the acid/water seat over 6.5 minutes while stirring from 600 rpm (beginning injection) to 1800 rpm (end of injection). Add dye 2.5 minutes after beginning the premix injection. After the premix injection is complete, pump the lysine into the mix over 15 minutes. Viscosity should then be approximately 70–80 cps. Add 30–40 g of water to compensate for water evaporation. Add perfume over 1 minute. Viscosity is approximately 80–90 cps. Add soil release polymer over 1 minute. Viscosity is approximately 70–80 cps. Cool with a cold coil to 20°–25° C. (68°–77° F.) over 6 minutes. Viscosity is approximately 45–55 cps.

Process for Preparing Composition 6

For preparing a 1500 g batch, add into a water seat at 70°–72° C. (158°–162° F.) the HCl and the tallow choline ester chloride. Preheat the DEQA at 90°–95° C. (194°–203° F.) and inject it in the water seat in about 10 minutes. During the injection increase the agitation from 600 rpm to 1800 rpm after about 6 minutes. Dye is added after ⅓ of the premix is injected. When all the DEQA is injected, trim the product by slowly injecting the $CaCl_2$ in about 10 minutes. Reduce the mixing speed from 1800 rpm to 600 rpm to avoid foam formation. Viscosity after trimming is about 40–45 cps. Slowly add perfume and soil release polymer under constant agitation. The viscosity rises about 15 cps. Cool in about 6 minutes to about 25° C. (about 77° F.). The finished product has viscosity of 75–85 cps.

| | 4° C. | 10° C. | 21° C. | 35° C. | 50° C. |
|---|---|---|---|---|---|
| | Storage Profile of 1 (cps) | | | | |
| Fresh = (38) | (39.2° F.) | (50° F.) | (69.8° F.) | (95° F.) | |
| After 1 day: | 52 | 51 | 32 | 31 | |
| After 2 days: | 73 | 50 | 31 | 31 | |
| After 5 days: | 155 | 48 | 29 | 31 | |
| | Storage Profile of 2 (cps) | | | | |
| Fresh = (26) | (39.2° F.) | (50° F.) | (69.8° F.) | (95° F.) | |
| After 1 day: | 29 | — | 22 | 22 | |
| After 6 days: | 33 | — | 21 | 21 | |
| After 9 days: | 37 | — | 22 | 19 | |
| | Storage Profile of 3 (cps) | | | | |
| Fresh = (37) | (39.2° F.) | (50° F.) | (69.8° F.) | (95° F.) | |
| After 3 days: | 201 | — | 38 | 27 | |
| After 7 days: | 361 | — | 42 | 28 | |
| | Storage Profile of 4 (cps) | | | | |
| Fresh = (51) | (39.2° F.) | (50° F.) | (69.8° F.) | (95° F.) | (122° F.) |
| After 1 day: | 69 | 45 | 36 | 40 | 42 |
| After 7 days: | 120 | 48 | 35 | 44 | 57 |
| | Storage Profile of 5 (cps) | | | | |
| Fresh = (56) | (39.2° F.) | (50° F.) | (69.8° F.) | (95° F.) | |
| After 1 day: | 135 | 116 | 59 | 62 | |
| AFter 2 days: | 170 | 116 | 65 | 70 | |
| After 3 days: | 198 | 123 | 70 | 65 | |
| After 6 days: | 940 | 132 | 72 | 64 | |
| | Storage Profile of 6 (cps) | | | | |
| Fresh = (81) | (39.2° F.) | | (69.8° F.) | (95° F.) | (122° F.) |
| After 1 day: | 225 | | 80 | 73 | 48 |
| After 8 days: | 2500 | | 70 | 60 | 36 |
| | Storage Profile of 7 (cps) | | | | |
| Fresh = (37) | (39.2° F.) | (50° F.) | (69.8° F.) | (95° F.) | |
| After 1 day: | 95 | 55 | 38 | 40 | |
| After 2 days: | 125 | 67 | 42 | 40 | |
| After 4 days: | 185 | 82 | 40 | 40 | |

-continued

| | 4° C. | 10° C. | 21° C. | 35° C. | 50° C. |
|---|---|---|---|---|---|
| After 7 days: | 325 | 75 | 40 | 36 | |

EXAMPLE III

Various ethoxylated fatty alcohols are substituted into the formula of Example II (No. 1), with the following results. As used herein, the terminology "$C_n E_m$" refers to an ethoxylated fatty alcohol wherein the fatty alcohol contains n carbon atoms and the molecule contains an average of m ethoxy moieties.

| Ethoxylated Fatty Alcohol | Wt. % | HLB | Viscosity (cps) |
|---|---|---|---|
| a. $C_{13} E_3$ | 1.5 | 8 | 70 |
| b. $C_{13} E_8$ | 1.5 | 13 | 6,000 |
| c. $C_{16-18} E_{50}$ | 11.5 | 18 | 72 |
| d. $C_{16-18} E_{11}$ | 1.5 | 13 | 46 |
| e. $C_{13-15} E_{11}$ | 1.5 | 14 | 460 |
| f. $C_{10} E_7$ | 1.5 | 13 | Gel |
| g. Emulan OU | 1.5 | 17 | 900 |

The results after storage of compositions with the above formulas for one day at the indicated temperatures are as follows:

| 4° c. (39.2°F.) | 21° C. (69.8° F.) |
|---|---|
| a. Gel | a. Gel |
| b. Gel | b. Gel |
| c. 8.000 cps | c. 120 cps |
| d. 125 cps | d. 57 cps |
| e. Gel | e. Gel |
| f. Gel | f. Gel |
| g. Gel | g. Gel |

$C_{16}$–$C_{18}$ $E_{11}$ is an effective stabilizer at a sufficiently wide range of temperatures.

EXAMPLE IV

The following levels of $C_{16}$–$C_{18}$ $E_{11}$ are substituted into the formula of Example II (No. 1), with the following results:

| Ethoxylated Fatty Alcohol | Wt. % | HLB | Fresh Viscosity (cps) |
|---|---|---|---|
| a. $C_{16-18} E_{11}$ | 2.5 | 13 | 90 |
| b. $C_{16-18} E_{11}$ | 1.0 | 13 | 45 |
| c. $C_{16-18} E_{11}$ | 1.5 | 13 | 46 |

The results after storage of compositions with the above formulas for one day at the indicated temperatures were as follows:

| 4° C. (39.2° F.) | 21° C. (69.8° F.) |
|---|---|
| a. 500 cps | a. 140 |
| b. 190 cps | b. 49 |
| C. 125 cps | C. 57 |

The above data illustrates the ethoxylated fatty alcohol level which provides lower initial viscosities and improved viscosity stability.

EXAMPLE V

| Effect of Essentially Linear Monoester | | | |
|---|---|---|---|
| Component | 1 Wt. % | 2 Wt. % | 3 Wt. % |
| DEQA[1] | 25 | 23.1 | 21.2 |
| Methyl Tallowate | 0.38 | 2.2 | 4.1 |
| Coconut Choline Ester Chloride | 2.5 | 2.5 | 2.5 |
| $CaCl_2$ | 0.375 | 0.375 | 0.375 |
| Water | Balance | Balance | Balance |
| Initial Viscosity (cps) (At Room Temp.) | 54 | 110 | 154 |

[1]Di(tallowoyloxyethyl)dimethyl ammonium chloride.

Storage Results at about 4.4° C. (40° F.)

Ex. 1—Gels within about 2 days.

Ex. 2—About 520 cps after about 1 week; about 528 cps after about 3.5 weeks.

Ex. 3—About 1,900 cps after about 1 week; about 1,410 cps after about 3.5 weeks.

The above data indicates that there is a range of essentially linear fatty monoester that provides a viscosity lowering effect at low temperature, but that levels of 4% or greater can raise the viscosity as compared to the best level of such fatty monoester.

Preparation of Compositions

1. Place DEQA and, optionally, methyl tallowate into a borosilicate screw top Waring® cell. Seal the cell and place in an ~90° C. temperature bath.

2. Heat water to boiling then weigh into a screw top jar. Dissolve the coconut choline ester chloride into the heated water to form a clear solution. Keep this solution hot in a 90° C. temperature bath until the DEQA/methyl tallowate mixture is hot. (Note: Some water is left out (hole) for post addition of $CaCl_2$.)

3. Pour the hot choline ester solution over the hot DEQA mixture with a high shear mixer (Waring mixer). As soon as all of the water seat is transferred, increase the Waring mixer speed to full. Occasionally, stir the resulting gel with a spatula to ensure thorough mixing. About one-half gram of about 25% $CaCl_2$ stock solution is added to the hot mixture to aid mixing. After the mixing is complete, seal the Waring jar and cool its contents to room temperature with a running (20° C.) tap water.

4. The resulting liquid product is mixed under high shear (Tekmar® T-25) to ensure all chunks are dispersed. The resulting liquid is then recooled to room temperature and poured in a glass screw top jar. The remaining hole is then filled with about 25% $CaCl_2$ solution to bring the total $CaCl_2$ to about 0.375%. Water loss is now accounted for at this point (weight loss is assumed to be water loss, and product is brought to 100 parts). Viscosities are measured with a Brookfield® Model DVII viscometer using a No. 2 spindle at 60 rpm.

EXAMPLE VI

| Effect of DEQA "Monoester" Content | | | | |
|---|---|---|---|---|
| Component | 1 Wt. % | 2 Wt. % | 3 Wt. % | 4 Wt. % |
| DEQA[1] | 25 | 25 | 25 | 25 |
| Diester | 24.6 | 24.2 | 22.3 | 20.8 |
| Monoester | 0.4 | 0.75 | 1.9 | 3.0 |
| Methyl Tallowate in Finished Product | 2.1 | 2.2 | 2.0 | 2.0 |
| Coconut Choline Ester Choride | 2.5 | 2.5 | 2.5 | 2.5 |
| Ethanol | 3.0 | 2.8 | 2.5 | 3.0 |
| $CaCl_2$ | 0.2 | 0.3 | 0.3 | 0.5 |
| Water | Balance | Balance | Balance | Balance |
| Increase in Viscosity (cps) after 1 Week at Ambient Temp. | 2 | 12 | 80 | 275 |

[1]Di(tallowoyloxyethyl)dimethyl ammonium chloride.

The above data indicates the desirability of minimizing DEQA monoester content in choline ester-containing compositions. Preparation of Compositions 1. Weigh out 8% extra quantity of DEQA and methyl tallowate over calculated needs. Combine the materials in a beaker or jar and mix the solids well. Melt the covered contents in an oven set at about 80°–85° C. Allow about 2–4 hrs. for melting, depending on the batch size. The extra amounts are to offset transfer losses during product making.

2. Separately dissolve the coconut choline ester chloride in distilled water in a beaker using a magnet stirrer. Adjust the pH of this solution to about 2.3 with about 1N HCl. Cover beaker with foil and heat in digital water bath on bench, set to about 73° C. Add an extra about 5 g water per 100 g product to compensate for evaporative losses.

3. Set up assembly in hood, including mixer with appropriately sized turbine blade, dishes to serve as baths, ice water bath dish. Set hot plate underneath main mix bath to obtain a temperature of about 71° C. (about 160° F.), and the other bath to read about 82° C. (about 180° F.).

4. Weigh out calcium chloride.

5. Check premix in the oven, and, if necessary, manually or magnetically stir the contents while in the hot water bath in the hood. Meanwhile, set the water seat beaker in the main mix bath underneath the mixer.

6. Remove foil cover from beaker containing water seat, start mixer at about 250 rpm. Immediately begin slowly but steadily pouring the premix into the water seat under agitation, ramping up speed as necessary. Be prepared to carefully raise and lower mixer to homogenize the contents at about 1200 rpm. Try to transfer most of the premix, and weigh the beaker to determine how much is transferred.

7. Continue mixing, and add half of the total electrolyte solution. Mix for four minutes to ensure homogeneity.

8. Shut off the stirrer, lift the main mix beaker, push aside hot plate, and bring an ice water bath and lab jack underneath the beaker. Continue mixing product in ice bath, monitoring temperature and ramping down speed as necessary. Within about 1–2 minutes, the temperature should come down to about 43°–46° C. (about 110°–115° F.), at which point the remaining half of the electrolyte solution is added, drastically thinning the product. Continue mixing for another about 3–4 minutes, when the temperature should reach ambient.

9. Shut off the mixer, remove the product and weigh. Measure pH on neat product and at about 4% in water.

Calculate the adjusted DEQA concentration based upon final weight of product and weight of premix transferred over.

10. Measure viscosity with a Brookfield DVII viscometer using a No. 2 spindle at 60 rpm after waiting about 1 hr. for most of the air to rise out of the product.

EXAMPLE VII

| Component | Viscosity Stability Wt. % | Wt. % | Wt. % |
|---|---|---|---|
| | 1 | 2 | 3 |
| DEQA[1] | 25.0 | 25.0 | 25.0 |
| Diester | 23.5 | 23.5 | 23.5 |
| Monoester | 0.83 | 0.83 | 0.83 |
| Methyl Tallowate | 0.3 | 0.3 | 0.3 |
| Coconut Choline Ester Chloride | — | — | 2.5 |
| Ethanol | — | 2.8 | — |
| $CaCl_2$ | 0.375 | 0.375 | 0.375 |
| Water | Balance | Balance | Balance |
| | 4 | 5 | 6 |
| DEQA[1] | 25.0 | 23.0 | 23.0 |
| Diester | 23.5 | 21.7 | 21.7 |
| Monoester | 0.83 | 0.76 | 0.76 |
| Methyl Tallowate | 0.3 | 2.3 | 2.3 |
| Coconut Choline Ester chloride | 2.5 | 2.5 | 2.5 |
| Ethanol | 2.8 | — | 2.8 |
| $CaCl_2$ | 0.375 | 0.375 | 0.375 |
| Water | Balance | Balance | Balance |

[1]Di(tallowoyloxyethyl)dimethyl ammonium chloride.

Preparation of Compositions

1. Place DEQA and methyl tallowate into a borosilicate screw top Waring cell. Seal the cell and place in a ~90° C. temperature bath.

2. Heat water to boiling then weigh into a screw top jar. Dissolve the coconut choline ester chloride into the heated water to form a clear solution. Keep this solution hot in the ~90° C. temperature bath until the DEQA/methyl tallowate mixture is hot. (Note: Some water is left out (hole) for post addition of $CaCl_2$ in water.)

3. Pour the hot choline ester solution over the hot DEQA mixture with a high shear mixer (Waring®). As soon as all of the water seat is transferred, increase the Waring mixer's speed to full. Occasionally, stir the resulting gel with a spatula to ensure thorough mixing. One-half gram of about 25% $CaCl_2$ stock solution is added to the hot mixture to aid mixing. After the mixing is complete, seal the Waring jar and cool its contents to room temperature with a running, about 20° C., tap water bath.

4. The resulting liquid product is mixed under high shear (Tekmar T25) to ensure all chunks are dispersed. The resulting liquid is then recooled to room temperature and stored in a glass screw top jar. The remaining hole is then filled with 25% $CaCl_2$ solution to bring total $CaCl_2$ to about 0.375%. Water loss is now accounted for at this point (weight loss is assumed to be water loss, and product is brought to 100 parts). Viscosities are measured with a Brookfield Model DVII viscometer using a No. 2 spindle at 60 rpm.

| Cycle | Composition 1 | 2 | 3 | 4 | 5 | 6 |
|---|---|---|---|---|---|---|
| | Number of Days Storage for Each Cycle | | | | | |
| 1 | * | * | 6 | 6 | 6 | 6 |
| 2 | 2 | 2 | 8 | 8 | 8 | 8 |
| 3 | 4 | 4 | 10 | 10 | 10 | 10 |
| 4 | 7 | 7 | 13 | 13 | 13 | 13 |
| 5 | 9 | 9 | 15 | 15 | 15 | 15 |
| 6 | 11 | 11 | 17 | 17 | 17 | 17 |
| 7 | 15 | 15 | 21 | 21 | 21 | 21 |
| 8 | 17 | 17 | 23 | 23 | 23 | 23 |
| | Component Influence on Viscosity (cps) | | | | | |
| Initial | 112 | 434 | 32.1 | 265 | 160 | 172 |
| 1 21° C. (70° F.) | 118 | 696 | 36.1 | 237 | 90.2 | 130 |
| 2 21° C. (70° F.) | 124 | 837 | 40.1 | 260 | 90.2 | 130 |
| 3 21° C. (70° F.) | 130 | 925 | 36.1 | 249 | 90.2 | 130 |
| 4 21° C. (70° F.) | 132 | 885 | 40.1 | 237 | 94.2 | 132 |
| 5 21° C. (70° F.) | 146 | 1030 | 44.1 | 252 | 98.2 | 134 |
| 6 21° C. (70° F.) | 144 | 1100 | 48.1 | 252 | 100 | 136 |
| 7 21° C. (70° F.) | 146 | 1240 | 45.9 | 244 | 102 | 144 |
| 8 21° C. (70° F.) | 146 | 1060 | 50.1 | 260 | 102 | 144 |
| 1 38° C. (100° F.) | | | 38.1 | 588 | 174 | 409 |
| 2 38° C. (100° F.) | 146 | cream | 36.1 | 496 | 195 | 450 |
| 3 38° C. (100° F.) | 185 | cream | 36.1 | 673 | 214 | 480 |
| 4 38° C. (100° F.) | 195 | cream | 34.1 | 591 | 244 | 466 |
| 5 38° C. (100° F.) | 207 | cream | 34.1 | 451 | 262 | 451 |
| 6 38° C. (100° F.) | 244 | cream | 34.1 | 508 | 279 | 438 |
| 7 38° C. (100° F.) | 306 | cream | 34.1 | 525 | 306 | 400 |
| 8 38° C. (100° F.) | 314 | cream | 35 | 480 | 306 | 365 |

A cycle consists of storage (in days) of product at indicated temperature, followed by equilibration at ambient temperature and measurement of viscosity. The time of storage for each cycle is indicated in the table above.

The above results illustrate the negative, viscosity increasing, effect on the composition of low molecular weight organic solvents like ethanol. The monoalkyl cationic surfactant and the essentially linear fatty acid ester, at low levels, provide some positive, viscosity-lowering and stabilizing activity.

EXAMPLE VIII

| Component | Solid Particulate Compositions Plus Water to Form Liquid Compositions 1 Wt. % | 2 Wt. % | 3 Wt. % | 4 Wt. % | 5 Wt. % | 6 Wt. % | 7 Wt. % | 8 Wt. % | 9 Wt. % |
|---|---|---|---|---|---|---|---|---|---|
| DEQA[1] | 8.1 | 7.74 | 6.00 | 7.6 | 7.6 | 7.6 | 7.6 | 8.1 | 23.5 |
| Ethoxylated Fatty Alcohol[2] | 0.5 | 0.86 | — | 1 | 1 | 1 | 1 | — | — |
| PGMS[3] | — | — | 1.74 | | | | | | |
| Coconut Choline Ester Chloride | — | — | 0.86 | | | | — | 0.5 | 2.5 |
| Minors (Perfume; | 0.35 | 0.35 | 0.35 | | | | — | 0.35 | 1.5 |

-continued

| Component | Solid Particulate Compositions Plus Water to Form Liquid Compositions | | | | | | | | |
|---|---|---|---|---|---|---|---|---|---|
| | 1 Wt. % | 2 Wt. % | 3 Wt. % | 4 Wt. % | 5 Wt. % | 6 Wt. % | 7 Wt. % | 8 Wt. % | 9 Wt. % |
| Antifoam) | | | | | | | | | |
| Electrolyte | | | | | | | — | — | 0.4 |
| Viscosity (cps) | 800 | 320 | 7 | 350 | 322 | 125 | 37 | 35 | 150 |

(1)Di(tallowoyloxyethyl)dimethyl ammonium chloride.
(2)1 and 2 are $C_{16}$–$C_{18}$ $E_{18}$; 4 is $C_{16}$–$C_{18}$ $E_{11}$; 5 is $C_{16}$–$C_{18}$ $E_{18}$; 6 is $C_{16}$–$C_{18}$ $E_{50}$; and 7 is $C_{10}$ $E_{11}$.
(3)Polyglycerol monostearate having a trade name of Radiasurf 7248.

The above liquid compositions were made from the corresponding solid compositions having the same active material, on a 100% weight basis, by the procedure given below. This shows the surprising ability of the solid particulate compositions herein to effectively disperse following simple addition to lukewarm water with gentle agitation (e.g., manual shaking). Improved results are obtained by using higher temperatures and/or effective mixing conditions, e.g., high shear mixing, milling, etc, However, even the mild conditions provide acceptable aqueous compositions.

Procedure

Molten DEQA is mixed with molten ethoxylated fatty alcohol or molten coconut choline ester chloride. In No. 3, molten PGMS is also added. The mixture is cooled and solidified by pouring onto a metal plate, and then ground. The solvent is removed by a Rotovapore® (2 hrs. at 40°–50° C. at maximum vacuum). The resulting powder is ground and sieved. The reconstitution of the powder is standardized as follows:

The total active solid is 8.6% (DEQA plus ethoxylated fatty alcohol). Tap water is heated to 35° C. (95° F.). Antifoam is added to the water. The active powder is mixed with the perfume powder. This mix is sprinkled on the water under continuous agitation (up to 2,000 rpm for 10 minutes). This product was cooled by means of a cooling spiral prior to storage. The fresh product is transferred to a bottle and left standing to cool.

EXAMPLE IX

| Concentrated Liquid Softening/Antistatic Compositions | | | |
|---|---|---|---|
| Component | 1 Wt. % | 2 Wt. % | 3 Wt. % |
| DEQA(1) | 21.4 | 21 | 18 |
| Ethoxylated Fatty Alcohol(2) | 1.0 | 0.5 | 0.5 |
| HCl | 0.336 | 0.08 | 0.14 |
| Soil Release Polymer(3) | 0.75 | 0.5 | 0.5 |
| $CaCl_2$ | 3.00% | 4,500 ppm | 4,500 ppm |
| Perfume | 1.20 | 1.20 | 1.2 |
| Dye | 0.006 | — | — |
| Preservative(4) | 0.02 | — | — |
| Antifoam(5) | 0.004 | — | — |
| Silicone(6) | 0.19 | — | — |
| Imidazoline Ester(7) | 5.2 | 1.0 | 2.0 |
| MTTMAC(8) | — | 1.2 | 1.2 |
| Citric acid | 0.12 | — | — |
| Water | Balance | Balance | Balance |
| Viscosites (cps): | | | |
| Initial (21° C.) | 113 | 88 | 49 |
| Aged (21° C.) | 140 | 85 | 88 |
| at Day/Days: | 1 | 7 | 30 |

-continued

| Concentrated Liquid Softening/Antistatic Compositions | | | |
|---|---|---|---|
| Component | 1 Wt. % | 2 Wt. % | 3 Wt. % |

(1)Di(tallowoyloxyethyl)dimethyl ammonium chloride.
(2)$C_{16}$–$C_{18}$ fatty alcohol with $E_{50}$ in 1; $C_{16}$–$C_{18}$ fatty alcohol with $E_{10}$ in 2 and 3.
(3)Copolymer of ethylene oxide and terephthalate with the generic soil release fromula of (C)(5) wherein each X is methyl, each n is 40, u is 4, each $R^1$ is essentially 1,4-phenylene moieties, each $R^2$ is essentially ethylene, 1,2-propylene moieties, or mixtures thereof.
(4)Kathon (1.5%).
(5)Dow Corning Antifoam 2210.
(6)Dow Corning Silicone DC-200 having a viscosity of 1 cst.
(7)Ditallowalkyl imidazoline ester.
(8)Monotallow trimethylammonium chloride.

Composition 1 has excellent static performance, at a pH of 2.78. The liquid compositions of 2 and 3 of the above examples are added to the rinse cycle of a conventional washing machine during the final rinse. The amount added to the rinse cycle is generally from about 10 ml to about 150 ml (per 3.5 kg of fabric being treated), and the temperature of the rinse water is 70° F. or less. Compositions 2 and 3 have excellent softening performance and viscosity stability.

Preparation for 1

Combine DEQA, ethoxylated fatty alcohol, soil release polymer, and imidazoline ester and mix at 114° C. (238° F.). Add HCl and citric acid to the water seat and heat to 91° C. (196° F.). Inject premix into the hot water seat over about 6 minutes with vigorous mixing. Add a premix of perfume and silicone. Add $CaCl_2$ (1.55%) over about 6 minutes. Cool product through a plate frame heat exchanger to 22° C. (72° F.). Add 0.45% $CaCl_2$, Kathon, dye, and antifoam to cooled product. One day later add 1.0% $CaCl_2$ to composition.

Preparation for 2 and 3

Combine DEQA, imidazoline ester, ethoxylated fatty alcohol, and MTTMAC in a sealed jar and heat to 82°–85° C. for 2–5 hours depending on batch size. Dissolve soil release polymer in distilled water acidified to pH of 1.7 with HCl. Seal jar and heat to 72° C. in a water bath. Transfer the acid/water seat to a mixing vessel equipped with a stirrer motor, baffles, and a varied disc impeller, set in a bath at 70° C. Slowly pour or pump the premix into the agitated water seat over 2–3 minutes. Halfway through the premix addition, add 20% of the $CaCl_2$. Increase agitation up to ~1,100–1,200 rpm. Add the remaining premix followed by another 30% of the $CaCl_2$, and the perfume. Mix composition with Tekmar SD-45® for one minute at 450–500 rpm. Chill composition on ice bath or jacketed Hobart mixing vessel under agitation, so that the composition cools to room temperature within 5–8 minutes. During cool down, add the remaining $CaCl_2$ at 45° C.

EXAMPLE X

| Ethoxylated Fatty Alcohol, Fatty Amine, Fatty Acid Amine | HLB | Fresh Viscosity (cps) |
|---|---|---|
| 1. $C_{13-15}$ $E_8$ | 12.5 | 1300 |
| 2. $C_{13-15}$ $E_{11}$ | 14 | 1300 |
| 3. $C_{13-15}$ $E_{30}$ | 17 | 1300 |
| 4. $C_{12-14}$ $E_8$ | 13 | 75 |
| 5. $C_{16-18}$ $E_{18}$ | 13 | 36–45 |
| 6. $C_{16-18}$ $E_{18}$ | 13 | 40–44 |
| 7. $C_{16-18}$ $E_{25}$ | 16 | 44 |
| 8. $C_{16-18}$ $E_{50}$ | 18 | 57 |
| 9. $C_{10}$ $E_3$ (oxo alcohol) | 9 | 10,000 |
| 10. $C_{10}$ $E_7$ (oxo alcohol) | 13 | 10,000 |
| 11. $C_{10}$ $E_8$ (oxo alcohol) | 14 | 10,000 |
| 12. $C_{10}$ $E_{11}$ (oxo alcohol) | 15 | 10,000 |
| 13. $C_{13}$ $E_3$ (oxo alcohol) | 8 | 70 |
| 14. $C_{13}$ $E_5$ (oxo alcohol) | 10 | 11 |
| 15. $C_{13}$ $E_8$ (oxo alcohol) | 13 | 6,000 |
| 16. $C_{13}$ $E_{12}$ (oxo alcohol) | 14.5 | 6,000 |
| 17. Fatty Amine $E_{12}$ | — | Gel |
| 18. Fatty Amine $E_{10}$ | — | Gel |
| 19. Emulan OU (Fatty Alcohol Ethoxylate) | 17 | 900 |
| 20. Emulan OG (Fatty Alcohol Ethoxylate) | 17 | 900 |

| Ethoxylated Fatty Alcohol, Fatty Amine, Fatty Acid Amine | Day 1 RT 20–25° C. (68–77° F.) | Day 3 RT 20–25° C. (68–77° F.) | Day 1 4° C. (39.2° F.) |
|---|---|---|---|
| 1. $C_{13-15}$ $E_8$ | Gel | Gel | Gel |
| 2. $C_{13-15}$ $E_{11}$ | Gel | Gel | Gel |
| 3. $C_{13-15}$ $E_{30}$ | Gel | Gel | Gel |
| 4. $C_{12-14}$ $E_8$ | 6700 | Gel | Gel |
| 5. $C_{16-18}$ $E_{11}$ | 32–45 | 32–50 | 50–200 |
| 6. $C_{16-18}$ $E_{18}$ | 37–43 | 40–45 | 39–60 |
| 7. $C_{16-18}$ $E_{25}$ | 45 | 46 | Gel |
| 8. $C_{16-18}$ $E_{50}$ | — | 75 | — |
| 9. $C_{10}$ $E_3$ (oxo alcohol) | Gel | Gel | Gel |
| 10. $C_{10}$ $E_7$ (oxo alcohol) | Gel | Gel | Gel |
| 11. $C_{10}$ $E_8$ (oxo alcohol) | Gel | Gel | Gel |
| 12. $C_{10}$ $E_{11}$ (oxo alcohol) | Gel | Gel | Gel |
| 13. $C_{13}$ $E_3$ (oxo alcohol) | Gel | Gel | Gel |
| 14. $C_{13}$ $E_5$ (oxo alcohol) | Gel | Gel | Gel |
| 15. $C_{13}$ $E_8$ (oxo alcohol) | Gel | Gel | Gel |
| 16. $C_{13}$ $E_{12}$ (oxo alcohol) | Gel | Gel | Gel |
| 17. Fatty Amine $E_{12}$ | Gel | Gel | Gel |
| 18. Fatty Amine $E_{10}$ | Gel | Gel | Gel |
| 19. Emulan OU (Fatty Alcohol Ethoxylate) | Gel | Gel | Gel |
| 20. Emulan OG (Fatty Alcohol Ethoxylate) | Gel | Gel | Gel |

| Ethoxylated Fatty Alcohol, Fatty Amine, Fatty Acid Amine | Day 3 RT 4° C. (39.2° F.) | Day 1 RT 10° C. (50° F.) | Day 1 10° C. (50° F.) |
|---|---|---|---|
| 1. $C_{13-15}$ $E_8$ | Gel | Gel | Gel |
| 2. $C_{13-15}$ $E_{11}$ | Gel | Gel | Gel |
| 3. $C_{13-15}$ $E_{30}$ | Gel | Gel | Gel |
| 4. $C_{12}$_$E_8$ | — | Gel | — |
| 5. $C_{16-18}$ $E_{11}$ | 200–Gel | 40–110 | 60–140 |
| 6. $C_{16-18}$ $E_{18}$ | Gel | 39–60 | 160–Gel |
| 7. $C_{16-18}$ $E_{25}$ | Gel | — | 170–Gel |
| 8. $C_{16-18}$ $E_{50}$ | Gel | — | 8,000 |
| 9. $C_{10}$ $E_3$ (oxo alcohol) | Gel | Gel | Gel |
| 10. $C_{10}$ $E_7$ (oxo alcohol) | Gel | Gel | Gel |
| 11. $C_{10}$ $E_8$ (oxo alcohol) | Gel | Gel | Gel |
| 12. $C_{10}$ $E_{11}$ (oxo alcohol) | Gel | Gel | Gel |
| 13. $C_{13}$ $E_3$ (oxo alcohol) | Gel | Gel | Gel |
| 14. $C_{13}$ $E_5$ (oxo alcohol) | Gel | Gel | Gel |
| 15. $C_{13}$ $E_8$ (oxo alcohol) | Gel | Gel | Gel |
| 16. $C_{13}$ $E_{12}$ (oxo alcohol) | Gel | Gel | Gel |
| 17. Fatty Amine $E_{12}$ | Gel | Gel | Gel |
| 18. Fatty Amine $E_{10}$ | Gel | Gel | Gel |
| 19. Emulan OU (Fatty Alcohol Ethoxylate) | Gel | Gel | Gel |
| 20. Emulan OG (Fatty Alcohol Ethoxylate) | Gel | Gel | Gel |

The data above represents a survey of nonionic surfactants in combination with DEQA. Initial product viscosities are favorable for a broad range of compositions, and tallow alcohol ethoxylate compositions exhibit the most favorable viscosity stability profiles.

EXAMPLE XI

DEQA Premix Fluidization/Viscosity (cps) at 95° C. (203° F.)

| Components | Ratio | Viscosity (cps) |
|---|---|---|
| DEQA[1]/$C_{18}$ Alcohol $E_{10}$ | 10:1 | 7,200 |
| DEQA[1]/$C_{18}$ Alcohol $E_{10}$/MTTMAC[2] | 10:1:1 | 800 |
| DEQA[1]/$C_{18}$ Alcohol $E_{10}$/IA[3] | 10:1:1 | 1,070 |
| DEQA[1]/$C_{18}$ Alcohol $E_{10}$/IAS[4] | 10:1:1 | 500 |
| DEQA[1]/$C_{18}$ Alcohol $E_{10}$/IE[5] | 9:1:1 | 40 |
| DEQA[1]/$C_{18}$ Alcohol $E_{10}$/IE[5] | 5:5:1 | 60 |
| DEQA[1]/$C_{12-13}$ Alcohol $E_{12}$ | 10:1 | 2,660 |
| DEQA[1]/$C_{12-13}$ Alcohol $E_{12}$/MTTMAC[2] | 10:1:1 | 3,450 |
| DEQA[1]/$C_{12-13}$ Alcohol $E_{12}$/IA[3] | 10:1:1 | 1,000 |
| DEQA[1]/$C_{12-13}$ Alcohol $E_{12}$/IAS[4] | 10:1:1 | 440 |
| DEQA[1]/$C_{14-15}$ Alcohol $E_{100}$ | 10:1 | 280,000 |
| DEQA[1]/$C_{14-15}$ Alcohol $E_{100}$/MTTMAC[2] | 10:1:1 | 4,250 |
| DEQA[1]/$C_{18}$ Alcohol $E_{20}$ | 10:1 | 7,300 |
| DEQA[1]/$C_{18}$ Alcohol $E_{20}$/MTTMAC[2] | 10:1:1 | 5,600 |
| DEQA[1]/$C_{18}$ Alcohol $E_{20}$/IA[3] | 10:1:1 | 840 |

[1]Di(tallowoyloxyethyl)dimethyl ammonium chloride.
[2]Monotallow trimethyl ammonium chloride.
[3]Tallow hydroxyethyl imidazoline - Varine HT ®.
[4]Stearyl hydroxyethyl imidazoline - Schercozoline S ®
[5]Ditallowalkyl imidazoline ester.

The data above shows the reduction of premix viscosity upon addition of a fluidizing agent to DEQA/nonionic surfactant premixes. All ingredients (DEQA, premix fluidizer, and viscosity and/or dispersibility modifier), were placed in a beaker in the oven at 95° C. until molten. Viscosity was measured using a Brookfield viscometer (Spindle No. 5 at 95° C.). These premixes can be solidified to form particulate compositions with particle size of from about 50 to about 1,000 microns, or injected into 70°–72° C. (158°–162° F.) water with high shear to form a concentrated, 24.5% DEQA liquid composition.

EXAMPLE XII

Viscosity of Concentrated Dispersions with Choline Ester

| Component | 1 Wt. % | 2 Wt. % | 3 Wt. % | 4 Wt. % |
|---|---|---|---|---|
| DEQA[1] | 20 | 20 | 20 | 20 |
| $CaCl_2$ | 0.375 | 0.375 | 0.375 | 0.375 |
| $C_{12}$ Choline Ester Chloride | — | 2 | — | 2 |
| Water | Balance | Balance | Balance | Balance |

[1]2,3 di(tallowoyloxyethyl)propyl trimethylammonium chloride for 1 and 2; di(tallowoyloxyethyl)(hycroxyethyl)methyl ammonium sulfate in 3 and 4.

The addition of single-long-chain-alkyl cationic surfactant improves fluidity and stability of the dispersions.

| | Room Temperature |
|---|---|
| Storage Profile of 1 (cps) | |
| Fresh = (867) | |
| After 1 day: | Cream |
| After 3 days: | Cream |
| After 31 days | Cream |
| Storage Profile of 2 (cps) | |
| Fresh = (115) | |
| After 1 day: | 2940 |
| After 3 days: | 1700 |
| After 31 days | 280 |
| Storage Profile of 3 (cps) | |
| Fresh = (Cream) | |
| After 1 day: | Cream |
| After 3 days: | Cream |
| After 31 days | Cream |
| Storage Profile of 4 (cps) | |
| Fresh = (57) | |
| After 1 day: | 35 |
| After 3 days: | 39 |
| After 31 days | 124 |

Preparation of 1 and 3

DEQA is dried to constant weight using a rotary evaporator. The dried solids are placed into a stainless steel Waring cell and heated to ~110° C. for 1 and ~90° C. water for 3. Pour boiling water over the molten DEQA with high shear mixing. One-third of the total $CaC_2$ is added (hot) resulting in thinning of the mixture. When the mixture looks homogeneous, cool to room temperature with a 20° C. temperature bath. Upon cooling, add the remaining $CaCl_2$ and mix with Waring blender. The dispersion thickens as mixing continues. Cool dispersion to room temperature. Initial viscosity (Brookfield LVTD VIII) is 867 cps in 1. In 3, the dispersion became a cream and remained a cream when cooled.

Preparation of 2 and 4

Combine dried DEQA with $C_{12}$ choline ester chloride and heat in a stainless steel Waring cell to ~110° C. in 2 and ~90° C. in 4. Pour boiling water over the molten mixture with high shear. Add one-third of the total $CaCl_2$ resulting in a thin dispersion. Cool to room temperature with a 20° C. temperature bath. Add remaining $CaCl_2$ to cooled sample. Upon mixing, this dispersion becomes very thin. Mill with a Tekmar® T25 mill and cool to room temperature. Initial viscosity (Brookfield LVTD VII) is 115 cps for 2 and 57 cps for 4.

All of the compositions in the above Examples, when used in a rinse cycle of a conventional automatic laundry process at a level to provide DEQA at a concentration of about 500 ppm, provide good softening. When the DEQA is replaced in the above Examples by the corresponding DEQAs wherein either a hydroxyethyl group replaces one methyl group, or the DEQA is a trimethylditallowoylglyceryl ammonium chloride, substantially similar results are obtained in that concentrated solid particulate compositions and stable concentrated liquid compositions are obtained; the premixes have satisfactory low viscosities; and fabrics are softened.

What is claimed is:

1. A concentrated fabric softening composition selected from the group consisting of:

I. a solid particulate composition comprising:

(A) from about 50% to about 95% of biodegradable diester quaternary ammonium fabric softening compound; and (B) from about 3% to about 30% of viscosity or dispersibility modifier selected from the group consisting of:

1. single-long-chain, $C_{12}$–$C_{22}$, alkyl, cationic surfactant;
2. nonionic surfactant with at least about 8 ethoxy moieties; and
3. mixtures thereof; and II. a concentrated liquid composition comprising:

(A) from about 15% to about 50% of biodegradable diester quaternary ammonium fabric softening compound; and (B) from about 0.1% to about 30% of viscosity or dispersibility modifier selected from the group consisting of:

1. single-long-chain, $C_{12}$–$C_{22}$, alkyl, cationic surfactant;
2. nonionic surfactant with at least about 10 ethoxy moieties; and
3. mixtures thereof; and (C) liquid carrier;

wherein the biodegradable diester quaternary ammonium fabric softening compound has a formula selected from the group consisting of:

(I) $(R)_{4-m}$—$N^+$—$[(CH_2)_n$—Y—$R^2]_m$ $X^-$ (Formula I); (II) $[R^2C(O)OCH_2][R^2C(O)O]CHCH_2N^+R_3$ $X^-$ (Formula II); and (III) mixtures thereof wherein each Y is —O(O)C—, or —C(O)—O—; m is 2 or 3; n is 1 to 4; each R is a $C_1$–$C_6$alkyl, hydroxyalkyl group, benzyl group, and mixtures thereof; each $R^2$ is a $C_{11}$–$C_{22}$hydrocarbyl or substituted hydrocarbyl substituent; and $X^-$ is any softener-compatible anion;

wherein more than 50% of said liquid carrier is water; wherein said diester quaternary ammonium fabric softening compound is at least about 80% diester; wherein the single-long-chain alkyl, cationic surfactant has a single $C_{12}$–$C_{22}$ alkyl chain and is selected from the group consisting of quaternary ammonium compounds, non-quaternary amines, alkyl imidazoline, imidazolinum, pyridine and pyridine salts; wherein said viscosity or dispersibility modifier affects the composition's viscosity, dispersibility, or both; wherein when said diester quaternary ammonium fabric softening compound has Formula (II), said viscosity or dispersibility modifier is single-long-chain, $C_{12}$–$C_{22}$, alkyl, catonic surfactant; and wherein said composition is essentially free of compositions having the Formula $(R)_{4-m}$—$N^+[$—$(CH_2)_n$—O—C(O)—O—$R^2]_mX^-$.

2. The composition according to claim 1 additionally comprising an effective amount to give additional stability to said concentrated liquid composition, up to about 10%, of a soil release polymer.

3. The composition according to claim 1 additionally comprising from about 0.5% to about 10% by weight of the composition for the liquid compositions and from about 10% to about 40% by weight of the composition for solid particulate compositions of polyglycerol monostearate nonionic fabric softener.

4. The composition according to claim 1 additionally comprising an effective amount of up to about 20% for liquid compositions and up to about 40% for solid particulate compositions, of di-substituted imidazoline for static control.

5. A molten premix suitable for preparation of a composition according to claim 1 comprising:

(a) diester quaternary ammonium compound; optionally, (b) viscosity or dispersibility modifier; and (c) premix fluidizer selected from the group consisting of:

1. linear fatty monoesters;
2. short chain ($C_1$–$C_3$) alcohols;
3. di-substituted imidazoline ester softening compounds;
4. imidazoline or imidazoline alcohols;
5. di-long chain, $C_{10-22}$, amines, di-long chain, $C_{10-22}$, ester amines, mono-long-chain, $C_{10-22}$, amines, mono-long-chain, $C_{10-22}$, ester amines, amine oxides;
6. alkyl and alkenyl succinic anhydrides and acids, long-chain, $C_{10-22}$, fatty alcohols, fatty acids, and
7. mixtures thereof.

6. A composition according to claim 5 which is a solid particulate composition, wherein (C) is selected from the group consisting of 1, 3, 4, and mixtures thereof.

7. A composition according to claim 1 which is a solid particulate composition, wherein the ratio of (A) to (B) is from about 15:1 to about 2:1; and said particulate composition having a particle size that is from about 50 to about 1,000 microns.

8. The composition according to claim 7 comprising:

(A) from about 60% to about 90% of diester quaternary ammonium fabric softening compound having the formula:

$$(R)_{4-m}—N^{\oplus}—[(CH_2)_n—Y—R^2]_m\ X^{\ominus}$$

wherein each Y is —O—(O)C—, or —C(O)—O—;

m is 2 or 3;

n is 1 to 4;

each R is a $C_1$–$C_6$ alkyl, hydroxyalkyl group, benzyl group, or mixtures thereof;

each $R^2$ is a $C_{12}$–$C_{22}$ hydrocarbyl or substituted hydrocarbyl substituent; and $X^{\ominus}$ is any softener-compatible anion; and (B) from about 5% to about 20% of viscosity or dispersibility modifier.

9. The composition according to claim 8 wherein m is 2, and each R is a $C_1$–$C_6$ alkyl group.

10. The composition according to claim 8 wherein m is 2, one R is a $C_1$–$C_6$ hydroxyalkyl group and one R is a $C_1$–$C_6$ alkyl group.

11. The composition according to claim 9 wherein (B) is a single-long-chain, $C_{12}$–$C_{22}$, alkyl, cationic surfactant at a level of from about 3% to about 15% by weight of the composition.

12. The composition according to claim 11 wherein (B) is $C_{12}$–$C_{14}$ choline ester.

13. The composition according to claim 9 wherein (B) is a nonionic surfactant at a level of from about 5% to about 20% by weight of the composition.

14. The composition according to claim 13 wherein (B) is $C_{10}$–$C_{14}$ alcohol with poly(10–18)ethoxylate.

15. The composition according to claim 9 which additionally comprises an effective amount, up to 10%, of a soil release polymer which provides improved stability to the composition.

16. The composition according to claim 7 comprising:

(A) from about 60% to about 90% of diester quaternary ammonium fabric softening compound having the formula:

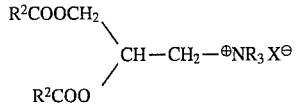

wherein each R is a $C_1$–$C_4$ alkyl, hydroxy alkyl, benzyl group, or mixtures thereof;

each $R^2$ is a $C_{11}$–$C_{22}$ alkyl group; and $X^{\ominus}$ is any water-soluble anion; and (B) from about 5% to about 20% of viscosity or dispersibility modifier.

17. The composition according to claim 16 wherein each R is a methyl group and each $R^2$ is a $C_{16}$–$C_{18}$ alkyl group.

18. The composition according to claim 17 wherein (B) is a single-long-chain, $C_{12}$–$C_{22}$, alkyl, cationic surfactant at a level of from about 3% to about 15% by weight of the composition.

19. The composition according to claim 18 wherein (B) is $C_{12}$–$C_{14}$ choline ester.

20. The composition according to claim 17 wherein (B) is a nonionic surfactant at a level of from about 5% to about 20% by weight of the composition.

21. The composition according to claim 20 wherein (B) is $C_{10}$–$C_{14}$ alcohol with poly(10–18)ethoxylate.

22. The composition according to claim 17 which additionally comprises an effective amount, up to 10%, of a soil release polymer which provides improved stability to the composition.

23. A composition according to claim 1 which is a solid particulate composition, suitable for making liquid compositions at a level of from about 5% to about 50% of diester quaternary ammonium compound wherein said solid particulate composition additionally comprises: from about 0.05% to about 5% inorganic electrolyte; from about 0.3% to about 3% of soil release polymer; an effective amount of perfume, dye, antifoam, flow aid, or mixtures thereof, to improve the stability of said concentrated liquid compositions.

24. A composition according to claim 1 which is a concentrated liquid composition, wherein the ratio of (A) to (B) is from about 8:1 to about 30:1.

25. The composition according to claim 24 comprising:

(A) from about 15% to about 35% of diester quaternary ammonium fabric softening compound having the formula:

$$(R)_{4-m}—N^{\oplus}\text{-}_m\ X^{\ominus}$$

wherein each Y is —O—(O)C—, or —C(O)—O—;

m is 2 or 3;

n is 1 to 4;

each R is a $C_1$–$C_6$ alkyl, hydroxyalkyl group, benzyl group, or mixtures thereof;

each $R^2$ is a $C_{12}$–$C_{22}$ hydrocarbyl or substituted hydrocarbyl substituent; and $X^{\ominus}$ is any softener-compatible anion; and (B) from about 0.2% to about 20% of viscosity or dispersibility modifier.

26. The composition according to claim 25 wherein m is 2 and each R is a $C_1$–$C_6$ alkyl group.

27. The composition according to claim 25 wherein m is 2, one R is a $C_1$–$C_6$ hydroxyalkyl group and one R is a $C_1$–$C_6$ alkyl group.

28. The composition according to claim 26 wherein (B) is a single-long-chain, $C_{12}$–$C_{22}$, alkyl, cationic surfactant at a level of from about 0.5% to about 15% by weight of the composition.

29. The composition according to claim 28 wherein (B) is $C_{10}$–$C_{18}$ choline ester.

30. The composition according to claim 28 wherein (B) is $C_{10}$–$C_{18}$ alkyl trimethylammonium.

31. The composition according to claim 26 wherein (B) is a nonionic surfactant at a level of from about 0.1% to about 5% by weight of the composition.

32. The composition according to claim 31 wherein (B) has from about 8 to about 30 ethoxy moieties.

33. The composition according to claim 31 wherein (B) is a $C_{16}$–$C_{18}$ alcohol ethoxylated with from about 10 to about 15 ethoxylates.

34. The composition according to claim 31 wherein (B) is a $C_{16}$–$C_{18}$ alcohol ethoxylated with from about 20 to about 30 ethoxylates.

35. The composition according to claim 26 which additionally comprises an effective amount of up to 10% of a soil release polymer which provides improved stability to the composition.

36. The composition according to claim 24 comprising:

(A) from about 15% to about 35% of diester quaternary ammonium fabric softening compound having the formula:

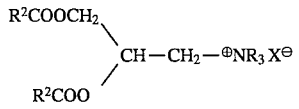

wherein each R is a $C_1$–$C_4$ alkyl, hydroxy alkyl, benzyl group, or mixtures thereof;

each $R^2$ is a $C_{11}$–$C_{22}$ alkyl group; and $X^{\ominus}$ is any water-soluble anion; and (B) from about 0.2% to about 20% of viscosity or dispersibility modifier.

37. The composition according to claim 36 wherein each R is a methyl group and $R^2$ is a $C_{16}$–$C_{18}$ alkyl group.

38. The composition according to claim 37 wherein (B) is a single-long-chain, $C_{12}$–$C_{22}$, alkyl, cationic surfactant at a level of from about 0.5% to about 15% by weight of the composition.

39. The composition according to claim 38 wherein (B) is $C_{10}$–$C_{18}$ choline ester.

40. The composition according to claim 38 wherein (B) is $C_{10}$–$C_{18}$ alkyl trimethylammonum.

41. The composition according to claim 39 wherein (B) is a nonionic surfactant at a level of from about 0.1% to about 5% by weight of the composition.

42. The composition according to claim 41 wherein (B) has from about 8 to about 30 ethoxylates.

43. The composition according to claim 42 wherein (B) is a $C_{16}$–$C_{18}$ alcohol ethoxylated with from about 10 to about 15 ethoxylates.

44. The composition according to claim 41 wherein (B) is a $C_{16}$–$C_{18}$ alcohol ethoxylated with from about 20 to about 30 ethoxylates.

45. The composition according to claim 37 which additionally comprises an effective amount of up to 10% of a soil release polymer which provides improved stability to the composition.

46. A process for making compositions according to claim 1 said compositions being solid particulate compositions suitable for making liquid compositions, having from about 5% to about 50% diester quaternary ammonium compound, comprising the steps of:

1. mixing diester quaternary ammonium compound and viscosity or dispersibility modifier with optional premix fluidizer and soil release polymer to form a premix;
2. cooling said premix to form a cooled, solidified premix;
3. grinding the cooled, solidified premix to a fine powder;
4. removing any solvent by heating or vacuum extraction and thereafter sieving said fine powder;
5. adding optional perfume, antifoam, and electrolyte;
6. agglomerating to form dust-free, free-flowing powder;
7. adding optional dye and flow aids to improve aesthetics or physical characteristics of the solid particulate compositions.

47. A process for preparing liquid softener compositions comprising the steps of:

(a) adding solid particulate compositions according to claim 1 to water having a temperature of from about 20° C. to about 90° C. to form a mixture; and (b) agitating the mixture to form a liquid composition;

wherein the resulting liquid composition has from about 5% to about 50% of diester quaternary ammonium fabric softening compound and from about 0.1% to about 30% of viscosity or dispersibility modifier.

48. The process according to claim 47 wherein said solid particulate compositions have an average particle diameter of from about 50 to about 1,000 microns.

49. A process for softening fabrics in a washer rinse cycle comprising rinse water, said process comprising adding an effective amount sufficient to soften said fabrics of the solid particulate compositions of claim 1 directly to the water in said washer rinse cycle.

50. The composition according to claim 2 wherein the polymer has the formula:

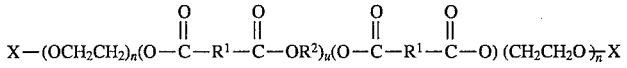

wherein:

each X is $C_1$–$C_4$ alkyl or acyl groups, or hydrogen;

each n is 6 to 113;

u is less than about 10;

each $R^1$ is phenylene, arylene, alkarylene, alkylene, an alkenylene moiety, or mixtures thereof;

each $R^2$ is ethylene or substituted ethylene, a 1,2-propylene, moiety, or mixtures thereof.

51. The composition according to claim 50 wherein:

each X is methyl;

each n is about 40;

u is about 4;

each $R^1$ is a 1,4-phenylene moiety; and each $R^2$ is ethylene, a 1,2-propylene moiety, or mixtures thereof.

52. The composition of claim 1 which is a solid particulate composition, wherein the nonionic surfactant is an alkoxylated alcohol having at least about 16–18 total carbon atoms when the number of ethoxy moieities is less than 11.

53. The composition of claim 1 which is a solid particulate composition, wherein the nonionic surfactant has at least about 16–18 total carbon atoms when the number of ethoxy moieties is less than 15.

54. A composition of claim 1 which is a concentrated liquid composition, wherein the nonionic surfactant is alkoxylated alcohol having at least about 16–18 total carbon atoms when the number of ethoxy moieties is less than 13.

55. The composition of claim 1 which is a concentrated liquid composition, wherein the nonionic surfactant has at least about 16–18 total carbon atoms when the number of ethoxy moieties is less than 15.

56. A concentrated fabric softening composition selected from the group consisting of:

I. a solid particulate composition comprising:

(A) from about 50% to about 95% of biodegradable diester quaternary ammonium fabric softening compound; and (B) from about 3% to about 30% of viscosity of dispersibility modifier selected from the group consisting of:

1. single-long-chain, $C_{12}$–$C_{22}$, alkyl, cationic surfactant;
2. nonionic surfactant with at least about 8 ethoxy moieties; and
3. mixtures thereof; and II. a concentrated liquid composition comprising:

(A) from about 15% to about 50% of biodegradable diester quaternary ammonium fabric softening compound; and (B) from about 0.1% to about 30% of viscosity or dispersibility modifier selected from the group consisting of:

1. single-long-chain, $C_{12}$–$C_{22}$, alkyl, cationic surfactant;
2. nonionic surfactant with at least about 10 ethoxy moieties; and
3. mixtures thereof; and (C) liquid carrier;

wherein the biodegradable diester quaternary ammonium fabric softening compound has the formula:

$$(R)_{4-m}—N^+—[(CH_2)_n—Y—R^2]_mX^-$$

wherein each Y is —O—(O)C—, or —C(O)—O—; m is 2 or 3; n is 1 to 4; each R is a $C_1$–$C_6$alkyl, hydroxyalkyl group, benzyl group, and mixtures thereof; each $R^2$ is a $C_{11}$–$C_{22}$ hydrocarbyl or substituted hydrocarbyl substituent; and $X^-$ is any softener-compatible anion;

wherein more than 50% of said liquid carrier is water, wherein said dieter quaternary ammonium fabric softening compound is at least about 80% diester; wherein the single-long-chain alkyl, cationic surfactant has a single $C_{12}$–$C_{22}$ alkyl chain is selected from the group consisting of quaternary ammonium compounds, non-quaternary amines, alkyl imidazoline, imidazolinium, pyridine and pyridine salts; wherein said viscosity or dispersibility modifier affects the composition's viscosity, dispersibility, or both; and wherein said composition is essentially free of compositions having the Formula $(R)_{4-m}—N^+—_m X^-$.

* * * * *